United States Patent [19]

Katada et al.

[11] Patent Number: 5,070,758

[45] Date of Patent: Dec. 10, 1991

[54] ELECTRONIC MUSICAL INSTRUMENT WITH AUTOMATIC MUSIC PERFORMANCE SYSTEM

[75] Inventors: Naota Katada; Kosei Terada; Tadashi Yamada, all of Hamamatsu, Japan

[73] Assignee: Yamaha Corporation, Hamamatsu, Japan

[21] Appl. No.: 353,176

[22] Filed: May 15, 1989

Related U.S. Application Data

[63] Continuation of Ser. No. 13,565, Feb. 11, 1987, abandoned.

[30] Foreign Application Priority Data

Feb. 14, 1986 [JP] Japan ..... 61-28920
Feb. 14, 1986 [JP] Japan ..... 61-28921
Feb. 14, 1986 [JP] Japan ..... 62-28922

[51] Int. Cl.[5] ..... G10H 7/00

[52] U.S. Cl. ..... 84/634; 84/610; 84/613; 84/622; 84/637

[58] Field of Search ..... 84/609-613, 84/622, 626, 634-638, 692, 701, 712-715, DIG. 12, DIG. 22

[56] References Cited

U.S. PATENT DOCUMENTS 4,331,057 5/1982 Wheelwright et al. ..... 84/DIG. 22
4,339,978 7/1982 Imamura ..... 84/1.03
4,345,501 8/1982 Nakada et al. ..... 84/1.03
4,361,067 11/1982 Ishii ..... 84/1.03 X
4,391,176 7/1983 Niinomi et al. ..... 84/712
4,476,766 10/1984 Ishii ..... 84/1.17 X
4,587,878 5/1986 Nakada et al. ..... 84/1.28 X
4,674,382 6/1987 Yorihisa ..... 84/626
4,674,383 6/1987 Suzuki ..... 84/1.03

*Primary Examiner*—A. T. Grimley
*Assistant Examiner*—Matthew S. Smith
*Attorney, Agent, or Firm*—Spensley Horn Jubas & Lubitz

[57] ABSTRACT

An electronic musical instrument includes a first tone generator for generating a musical tone in response to each depression of key on an accompaniment keyboard and a second tone generator for generating a musical tone in accordance with the musical performance data read from the memory. In a specific mode, the player can cause the first tone generator to generate a musical tone through the accompaniment keyboard with the accompaniment being automatically played. In a mode for recording an accompaniment of a music into the memory in a step manner, a chord is detected from keys depressed on the accompaniment keyboard, and data representative of the detected chord is written into the memory together with data representative of a note-length designated by note-length selection switches. In a mode for recording an accompaniment in real time, each time keys are depressed, the chord data of the depressed keys is written into the memory together with the contents of a tempo clock counter. States of various control elements of a control panel for controlling the generation of the musical tone can also be stored into the memory. The control elements are automatically set to the stored states when the accompaniment is automatically played. If desired, only the control elements can be automatically set to the stored states so that the player can play an accompaniment without operating the control elements.

20 Claims, 21 Drawing Sheets

| VALUE | ROOT | VALUE | TYPE |
|---|---|---|---|
| 0 | C | 0 | M |
| 1 | C# | 1 | 6th |
| 2 | D | 2 | M 7 |
| 3 | D# | 3 | +5 |
| 4 | E | 4 | −5 |
| 5 | F | 5 | m |
| 6 | F# | 6 | m 6 |
| 7 | G | 7 | mM 7 |
| 8 | G# | 8 | 7th |
| 9 | A | 9 | $7^{+5}$ |
| $A_H$ | A# | $A_H$ | $7^{-5}$ |
| $B_H$ | B | $B_H$ | 7 SUS 4 |
| $C_H$ | BASE | $C_H$ | m 7 |
| $D_H$ | NOTE-LENGTH | $D_H$ | m $7^{-5}$ |
| $E_H$ | — | $E_H$ | dim |
| $F_H$ | OTHER THAN ACCOMPANIMENT | $F_H$ | N. A. |

| (MENU) | TBLED | TBLINC | TBLDEC |
|---|---|---|---|
| 1 | 2 | (1) | (1) |
| 2 | 4 | 3 | (3) |
| 3 | 8 | (2) | 2 |
| 4 | 1 | 5 | 7 |
| 5 | 1 | 6 | 4 |
| 6 | 1 | 7 | 5 |
| 7 | 1 | 4 | 6 |
| 8 | 1 | 9 | 9 |
| 9 | 1 | 8 | 8 |

ELECTRONIC MUSICAL INSTRUMENT WITH AUTOMATIC MUSIC PERFORMANCE SYSTEM

This is a continuation of application Ser. No. 07/013,565 filed on Feb. 11, 1987, now abandoned.

BACKGROUND OF THE INVENTION

1. Field of the Invention

The present invention relates to an electronic musical instrument with an automatic music performing system.

2. Prior Art

An electronic musical instrument with an automatic music performing system has heretofore been known which is arranged to perform an automatic accompaniment on the basis of a sustained tone of a depressed key and a so-called rhythmic chord in which the generation of the tone of the depressed key is controlled in accordance with a rhythm (Japanese Patent Application Laid-Open No. 59-197094). Although this prior-art instrument has two tone generating systems, it has a drawback that the generated sound is monotonous since both of the tone generating systems generate tones based on the same chord.

Another electronic musical instrument has been known in which, while a chord accompaniment is automatically being reproduced, generation of a tone corresponding to a depressed key is carried out (U.S. Pat. No. 4,339,978). This instrument is capable of performing a music in which the tone of a depressed key is superposed on the tone of an automatic accompaniment. However, since the tones generated are of the same tone color, it is impossible for this prior art instrument to independently carry out a musical performance based on depressed keys and an automatic accompaniment. Therefore, this instrument also has the drawback that the sound of the musical performed is monotonous.

In general, in order to impart variation to a music performed, it is required to generate a tone of a depressed key of an accompaniment keyboard independently of a tone of automatic accompaniment while the accompaniment tone is automatically being reproduced. However, the conventional electronic musical instruments cannot achieve such generation of the tones.

With the structure of another conventional electronic musical instrument, data representative of a music to be automatically performed are formed by recording in a memory the note name of each key which is operated (depressed and/or released) on the keyboard and the data representative of each timing of change of state of the operated key. In the automatic playing (reproducing) mode, the musical performance data thus formed are sequentially read from the memory and a musical tone is produced in accordance with these read data. One example of such electronic musical instrument is disclosed in Japanese Patent Application Laid-Open No. 58-205192. There has also been proposed a so-called chord sequencer in which the chords of an accompaniment are recorded by storing the kind and the note-length (beat length) of each chord using the keyboard and predetermined switch elements.

Such conventional electronic musical instrument is, however, disadvantageous in that since the note name of each operated key and the depressing or releasing timing of the key are stored during performing a music, the capacity of the memory for storing such musical performance data must be significantly large.

The above conventional chord sequencer can not record the accompaniment in real time, so that it is quite difficult to form and record data exactly representing an accompaniment which the performer wishes to let the instrument automatically play.

There has also been proposed a further electronic musical instrument with an automatic music performing system in which not only musical performance data for automatically reproducing the tones of a music but also other musical performance data for automatically changing a tone color, a musical effect are provided. In such electronic musical instrument, the musical performance data for automatically reproducing the tones are formed by storing the note name and the note length of each operated key, while the musical performance data for automatically changing the tone color, the musical effect and so on are formed by storing the state of control elements, such as a tone-color selection switch, a tone volume and so on, provided on the control panel. One example of such conventional electronic musical instrument is disclosed in Japanese Patent Laid-Open No. 59-131987.

It is sometimes desirable for such an electronic musical instrument to automatically perform the recorded music in a tone color different from that selected then the music was recorded.

It is also desired for the electronic musical instrument to automatically change the tone color, the musical effect and so on during the time when a music is manually performed on the keyboard of the instrument.

SUMMARY OF THE INVENTION

It is therefore ar object of the present invention to provide an electronic musical instrument which is capable of generating a tone of a key which has been depressed by the performer per se while a tone of an automatic accompaniment is being reproduced.

It is another object of the invention to provide an electronic musical instrument which can record, in real time, musical performance data for an automatic musical performance in accordance with the operation of keys on an associated keyboard with a minimized capacity of memory.

It is a further object of the invention to provide an electronic musical instrument in which an automatic musical performance based on musical performance data recorded in accordance with the operation of keys of an associated keyboard and automatic reproduction of state of control elements on the control panel independently of each other.

According to an aspect of the invention, there is provided an electronic musical instrument having an automatic music playing system comprising a keyboard having a plurality of keys; musical performance data generating means for generating musical performance data representative of a music to be automatically played; first tone generating means responsive to each key depressed on the keyboard for generating a first musical tone corresponding to the depressed key; second tone generating means responsive to the musical performance data for generating a second musical tone determined by the musical performance data; and tone color assigning means for assigning first and second tone colors respectively to the first tone generating means and the second tone generating means &o cause the first and second tone generating means to generate the first and second musical tones in the first and second tone colors, respectively.

According to another aspect of the invention, there is provided an electronic musical instrument having an automatic music playing system comprising a keyboard having a plurality of keys; note-length data generating means for generating note-length data representative of a note length; chord detection means responsive to each depression of key or keys on the keyboard for detecting a chord represented by the each depression of key to output chord data representative of the detected chord; memory means for storing a musical performance data representative of a music to be automatically played; musical performance data storing means responsive to the each depression of key on the keyboard for storing, into the memory means, the chord data together with the note-length data to form the musical performance data in the memory means; tempo clock signal generating means for generating a tempo clock signal representative of a tempo at which the music is to be automatically played; and musical performance data reading means responsive to the tempo clock signal for reading the musical performance da&a from the memory means at the tempo, so that a musical tone having a tone pitch determined by the chord data and having a time length determined by the note length data can be produced.

According to a further aspect of the invention, there is provided an electronic musical instrument having an automatic music playing system comprising a keyboard having a plurality of keys each for determining a pitch of a tone to be generated; tone control means having a plurality of control elements for outputting tone control signals for determining conditions of generation of the tone; memory means for storing first musical performance data corresponding to a music to be automatically played and relating to depressions of keys on the keyboard, and second musical performance data corresponding to the music and relating to states of the control elements; tempo clock signal generating means for generating a tempo clock signal representative of a tempo at which the music is to be automatically played; musical performance data reading means responsive to the tempo clock signal for selectively reading at least one of the first musical performance data and the second musical performance data from the memory means at the tempo, so that the music to be automatically played is performed when the first musical performance data is read from the memory means and that the control elements are brought into states determined by the second musical performance data when the second musical performance data is read from the memory means.

DESCRIPTION OF THE PREFERRED EMBODIMENT OF THE INVENTION

Overall Construction

Figure 1:
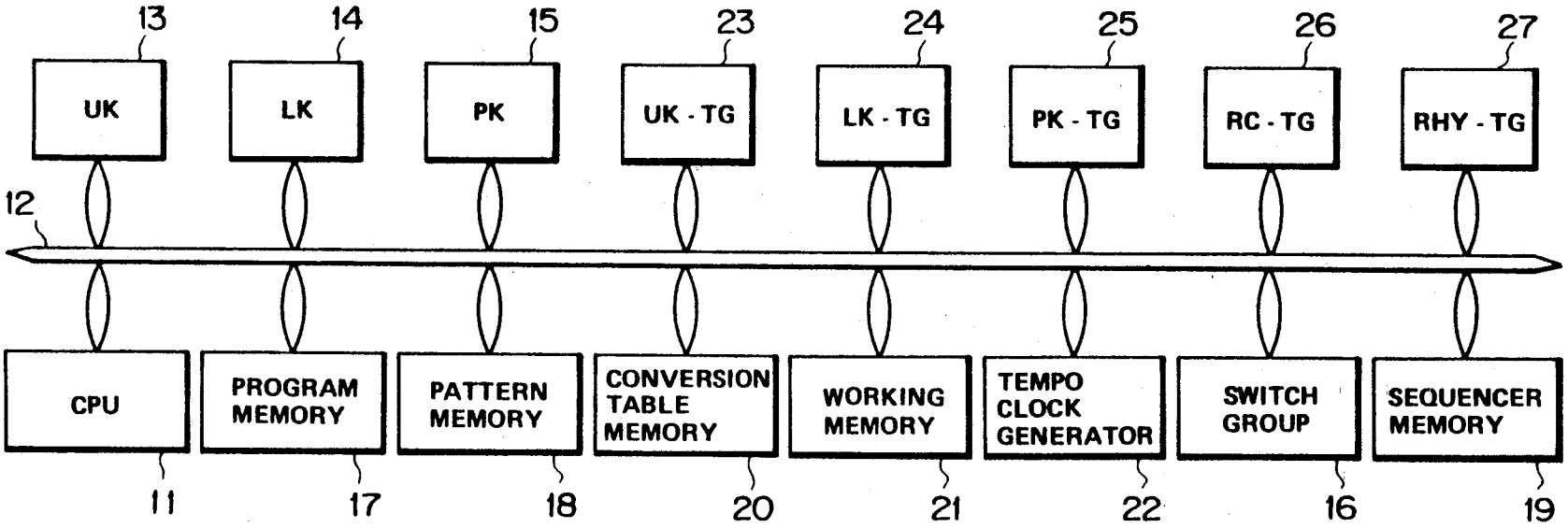
FIG. 1 is a block diagram of an electronic musical instrument provided in accordance with an embodiment of the present invention.

FIG. 1 shows an electronic musical instrument provided in accordance with the preferred embodiment of the present invention. This electronic musical instrument comprises a central processing unit (CPU) 11; an upper keyboard (UK) 13; a lower keyboard (LK) 14; a pedal keyboard (PK) 15; a switch group 16; a program memory 17; a pattern memory 18; a sequencer memory 19; a conversion table memory 20; a working memory 21; a tempo clock generator 22; and tone generators (TG) 23, 24, 25, 26 and 27 for generating tones for the upper keyboard 13, the lower keyboard 14, the pedal keyboard 15, a rhythmic chord and a rhythm. All of the above-described circuit sections are connected to one another through a bidirectional signal bus. This electronic musical instrument has not only a function of performing a music based on the keyboards as that of the conventional electronic musical instrument, but also a function of automatically performing (reproducing ) an accompaniment, such as rhythmic chords, on the basis of accompaniment patterns stored in the pattern memory 18 and musical-performance data (sequence data, i.e., accompaniment-tone data and panel data representative of states of a control panel) stored in the sequencer memory 19. The electronic musical instrument also has an auto-rhythm function of automatically performing a rhythm in accordance with a rhythm pattern stored in the aforesaid pattern memory 18. Moreover, the illustrated electronic musical instrument has a function of recording the aforementioned musical-performance data into the sequencer memory 19.

The mode for recording the performance-data includes a STEP WRITE mode and a REAL-TIME WRITE mode. The STEP WRITE mode is a mode in which each chord is recorded in response to an operation of the keyboard 14, a length of each tone are recorded in response to an operation of note-length switches 37 to 39 shown in FIG. 2 which will be described later, and a present number of the panel memory storing the aforementioned panel data is recorded in response to an operation of a preset write switch 36 and preset switches 55 to 70 shown in FIG. 2. The REAL-TIME WRITE mode is a mode in which, when a music is performed only by the lower keyboard 14, the instrument automatically detects and records chords and note-lengths of the chords which have been played.

It should be noted that, this illustrated electronic musical instrument is arranged to record the accompaniment data in the form of the chord (a root of of the chord and a type of the chord), whereby the capacity of the aforementioned pattern memory 18 with respect to the same accompaniment data is saved as compared with the conventional electronic musical instrument which records accompaniment data in the form of respective constituent tones of each chord.

This instrument also has a mode in which the aforesaid accompaniment data and the pedal data are individually reproduced.

In addition, the tone generator (LK.TG 24) for generating a musical tone based on the manual musical performance effected on the lower keyboard 14 and the tone generator (RC.TG 26) for generating a tone of the automatic accompaniment are separately provided, thereby enabling the separate setting of tore colors of the respective tones.

Referring to FIG. 1, the CPU 11 controls the entire operation of the electronic musical instrument, for example, reading key information output from the respective keyboards 13, 14 and 15 and switch and control-element information supplied from the switch group 16, forming musical-tone information (the start of generation of a tone, the stop of generation of the tone, data representative of a tone pitch, a tone color and the like) by effecting arithmetic operations based on the above information, and transferring the musical-tone information thus formed to the tone generators 23, 24, 25, 26 and 27.

The switches and the control elements constituting the switch group 16 are mounted on the operation panel (FIG. 2) of this electronic musical instrument.

Figure 2:
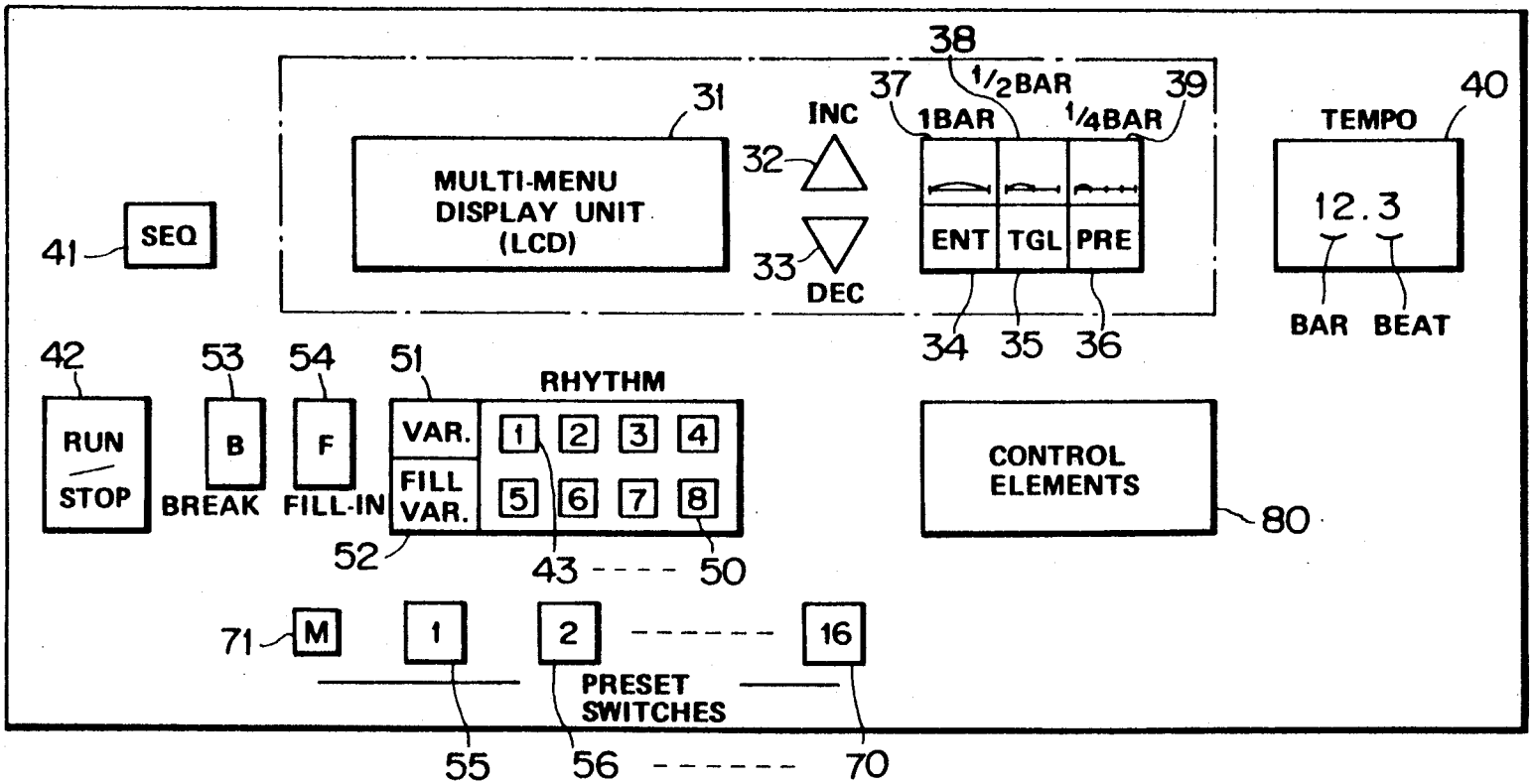
FIG. 2 is a schematic illustration of the appearance of the operation panel of the embodiment of FIG. 1.

FIG. 2 shows the operation panel of the electronic musical instrument of FIG. 1. The operation panel comprises a multi-menu display unit 31 which includes a liquid crystal display (LCD) for displaying the operation mode or other information. Menu selector switches 32, 33 and 34 and a toggle change switch 35 are provided for selecting a desired one of the various operation modes of this electronic musical instrument. A preset write switch 36 is used, during the RECORD mode, to write into musical-performance data a preset number for designating a panel memory (FIG. 6) in which a desired panel state is stored. Note-length switches 37, 38 and 39 are used to designate a note-length of a tone (the switches 37, 38 and 39 corresponding to a 1 bar, a ½ bar and a ¼ bar, respectively) in the aforementioned STEP WRITE mode. A tempo display unit 40 is arranged to display the bar number and the number cf beats during a musical performance or in the STEP WRITE mode. A sequencer switch (SEQ) 41 is a switch for determining whether an accompaniment based on the musical-performance da&a stored in the pattern memory 18 and the panel state should respectively be reproduced, that is, whether the instrument is in the SEQUENCER mode. A RUN/STOP switch 42 is used to start and stop the reproduction of the aforementioned accompaniment and the panel state, and to start and stop the auto-rhythm performance and the real-time write operation.

This operation panel further includes eight rhythm selector switches 43 to 50 for the auto-rhythm operation, selector switches 51 and 52 for selecting a variation and a fill-in pattern for each rhythm, a switch 53 for breaking the automatic musical performance during a musical performance, a switch 54 for effecting a fill-in operation (such as an insertion of an ad lib), sixteen preset switches 55 to 70 for designating panel data, and a memory switch 71 for storing the panel data.

As other control elements indicated collectively at 80, there are provided a rhythm volume setting element, a tone-color selector switch and a tone volume setting element for each of the aforementioned keyboards 13, 14 and 15, a tempo setting element for the automatic accompaniment and the autorhythm, and switches for respectively setting an auto-base chord, an arpeggio chord, a melody-on chord, a vibrato, a tremolo and a sustain.

Figure 3:
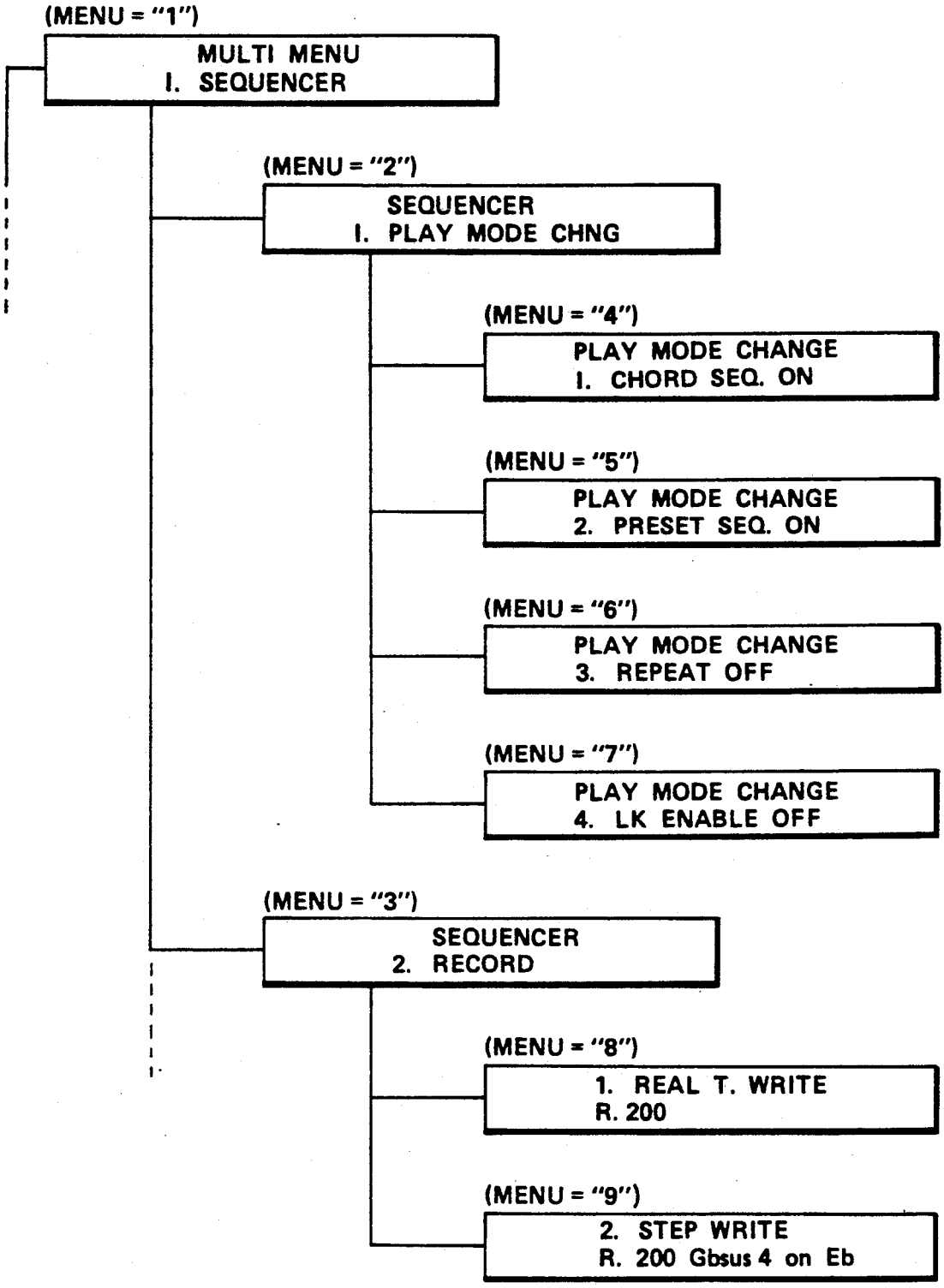
FIG. 3 is a chart of the system of operation menus and data displayed on the operation panel of FIG. 2.

FIG. 3 is a system chart of the operation menu of the electronic musical instrument shown in FIG. 1. Since the present invention primarily relates to an automatic performance mode, only a SEQUENCER mode (MENU="1") is shown as a primary classification. However, it is also possible to set other modes. Each time the ENT switch 34 among the menu selector switches 32 to 34 shown in FIG. 2 is pressed down, the operation menu of the electronic musical instrument of FIG. 1 is changed from one classification level to another classification level (the highest classification level is shown on the left side in FIG. 3), for example, from the menu of the primary classification (MENU="1") to the menu of the secondary classification (MENU="2" or "3"), from the menu of the secondary classification to the menu of the tertiary classification (any one of MENUs="4" to "9"), and conversely from the menu of the tertiary classification to the menu of the primary classification. When the INC or DEC switch 32 or 33 is pressed down, the operating menu is switched from one to another within the same classification level shown in FIG. 3.

Figures 11, 12:
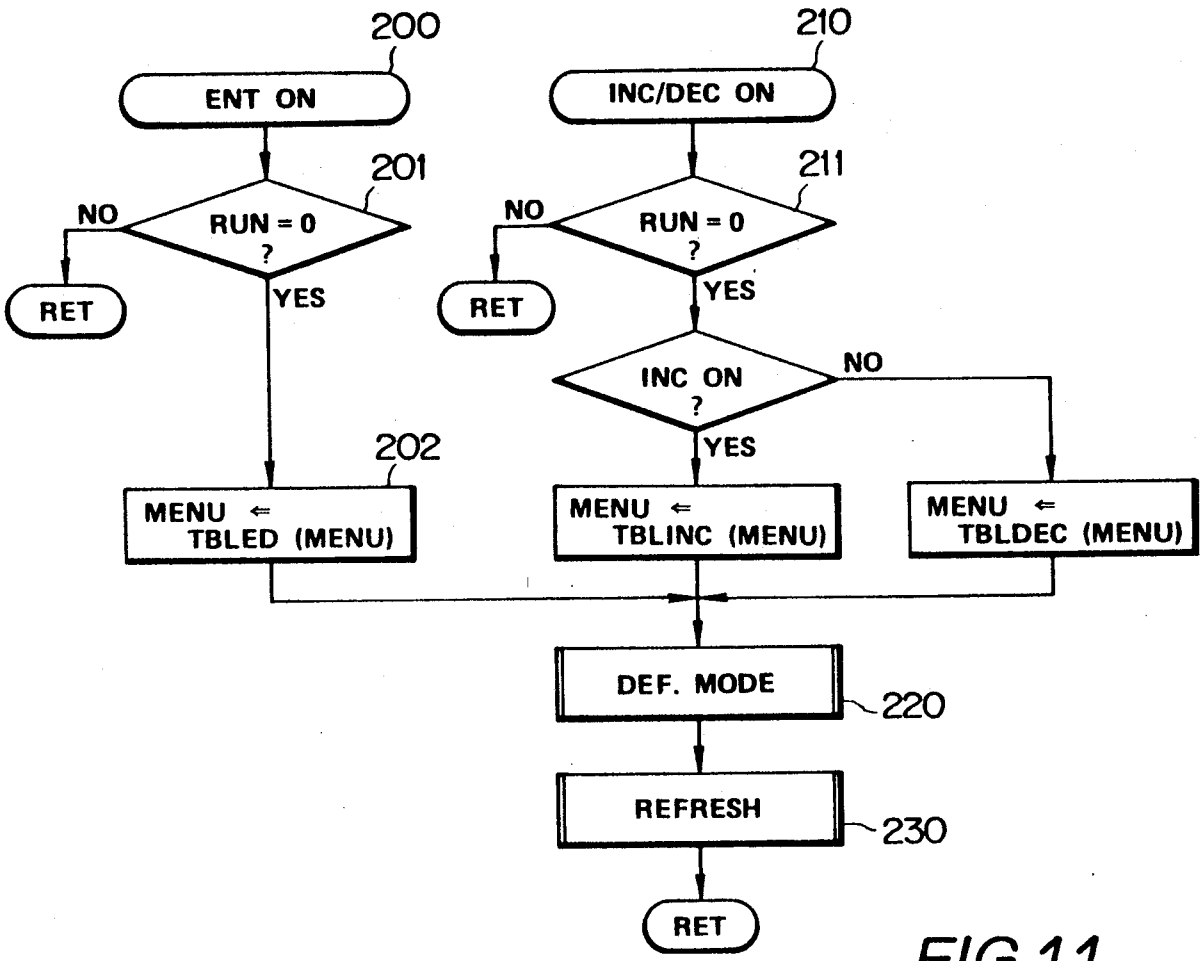
FIG. 11 is a flow chart of the menu selecting processing including an ENT switch-on processing and an INC/DEC switch-on processing executed by the CPU 11 of the embodiment of FIG. 1.
FIG. 12 is a table used for selecting the menus in the embodiment of FIG. 1.

Referring to FIG. 12 showing a table in which the manner of change of the operation menu is stored, a column of MENU represents the current operation menu, a column of TBLED representing an operation mode appearing after the ENT switch 34 is pressed once, and columns of TBLINC and TBLDEC respectively representing operation menus appearing after the INC and DEC switches 32 and 33 are pressed down once.

Referring back to FIG. 3, MENU="2" is a PLAY MODE CHANGE menu for partially changing a PLAY mode, this menu including MENU="4" for switching on and off the automatic accompaniment (or chord sequencer), MENU="5" for switching on and off a preset sequencer (for setting the panel state in accordance with musical-performance data), MENU="6" for switching on and off a REPEAT mode of the automatic musical performance (or sequencer), and MENU="7" for switching on and off an LK ENABLE mode for generating tones in accordance with the musical performance on the lower keyboard 14 at real time. MENU="3" is a RECORD mode, MENU="8" being a REALTIME WRITE mode and MENU="9" being a STEP WRITE mode.

The multi-menu display unit 31 shown in FIG. 2 displays the operation mode after each change of the menu, and also displays remaining bytes of the sequencer memory and the chord, which is inputted by a key depression of the lower keyboard 14 and the pedal keyboard 15, in the RECORD mode (MENU="8" or "9") (refer to the respective blocks shown in FIG. 3).

Referring again to FIG. 1, the program memory 17 is constituted by a read-only memory (ROM), in which a control program for the CPU 11 is stored.

The pattern memory 18 is a ROM in which are stored the accompaniment pattern data and the rhythm pattern data. The rhythm patterns are respectively prepared for the kind (number) of rhythms, variations and fill-in operations, the accompaniment patterns being respectively prepared for the kinds of rhythm, variations, fill-in operations, and the types of chord.

The sequencer memory 19 includes a random access memory (RAM) into which a user can write desired musical-performance data in the aforesaid WRITE mode. The sequencer memory 19 may be partially constituted by a ROM in which is stored the musical-performance data which has been prepared by a manufacturer.

Figure 4:
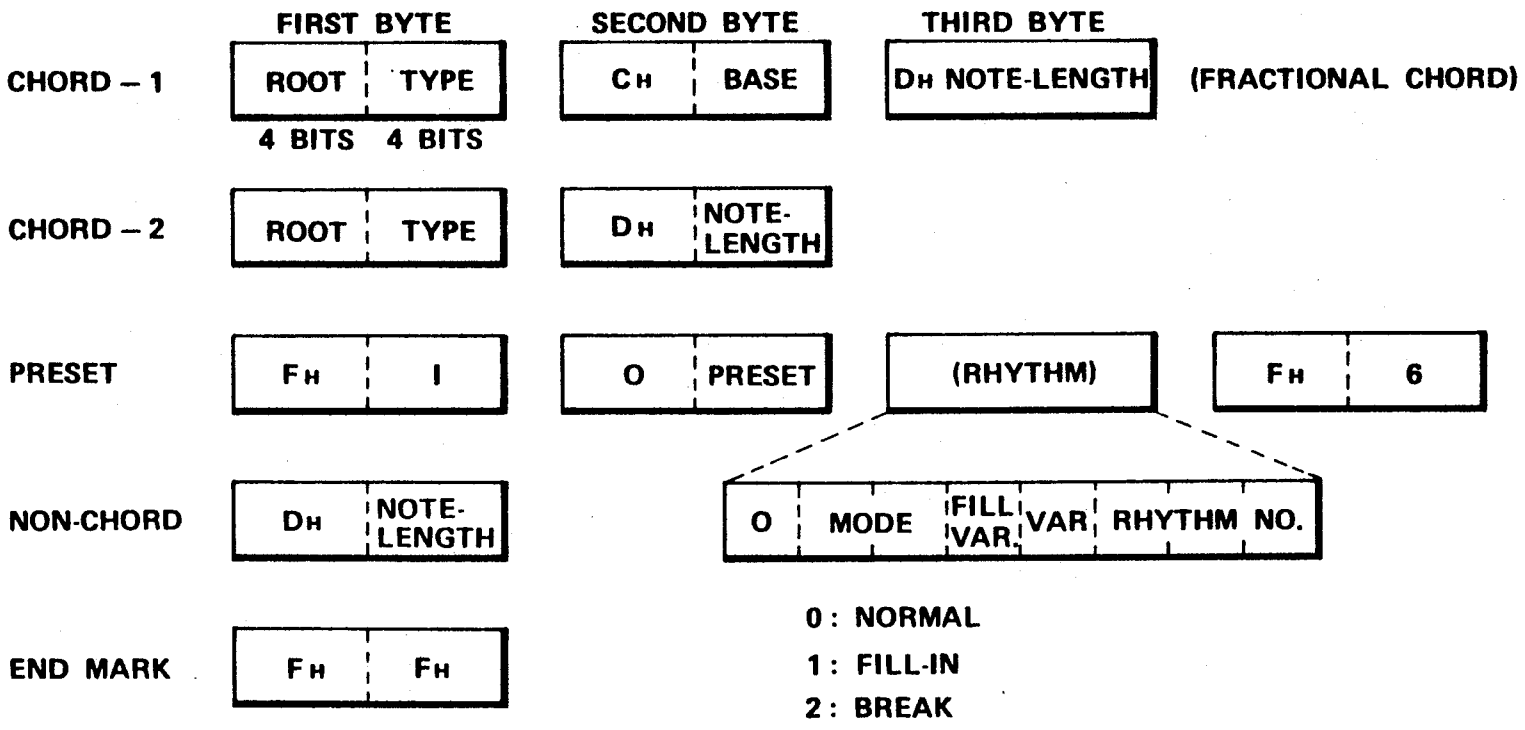
FIG. 4 is an illustration showing the format of various sequence data used in the embodiment of FIG. 1.

This musical-performance data, as shown in FIG. 4, is constituted by a suitable combination of fractional chord (chord-1) data having a word length of three bytes, normal chord (chord-2) data having a word length of two bytes, preset data having a word length of four bytes, non-chord (rest) data having a word length of one byte and an end mark.

Figures 5, 6:
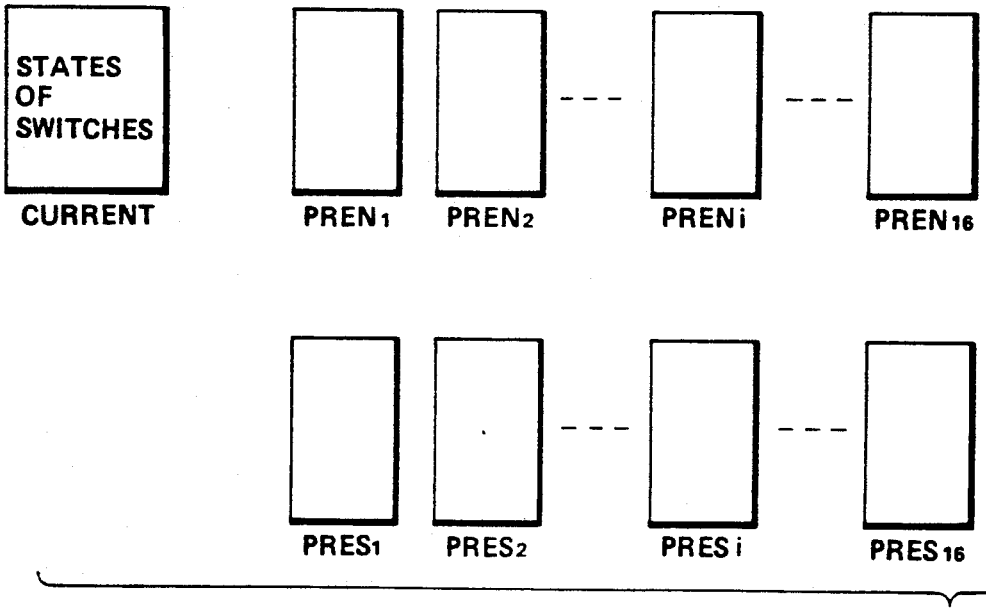
FIG. 5 is a table of the chords in terms of tone name data and chord-type data used in the embodiment of FIG. 1.
FIG. 6 is an illustration showing the format of the panel memory incorporated in the embodiment of FIG. 1.

The first byte of each of the chord (the chord-1 and chord-2) data represents a name of the chord. As shown in the table of FIG. 5, the chord-name data is constituted by the higher-order 4 bits corresponding to root data and the lower-order 4 bits corresponding to chord type data. The roots are arranged in such a manner that the names of twelve tones C, C#, ..., A# and B are assigned respectively to data "O" to "BH" ("B" represented in the hexadecimal notation), and the chord types Major (M), Sixth (6th), ..., being assigned respectively to the data "O" to "FH". (However, "FH" is not assigned any chord.)

The second byte of the chord-1 is constituted by a 4-bit discrimination mark CH representative of the fact that the kind of data is the base-tone data and 4-bit data "O" to "BH" representative of the names of roots for base tones. The same root data is used for &he data for the base tones and the chords (the accompaniment). Also, "FH" as the root data for the base tones represents "the absence of the base" (no base tone is generated).

Each of the third byte of the chord-1 and the second byte of the chord-2 is constituted by the discrimination mark "DH" for the data representative of a note-length and note-length data "1" to "3H". The note-length data "1H" represents one beat, the note-length data "2H" representing two beats, and the note-length data "3H" representing one bar (four beats).

The first byte of preset data contains a discrimination mark "F1H" indicative of the top of the preset data. The lower-order 4 bits of &he second byte of the same data represent a preset number (corresponding to the preset switches 1 to 16) "OH" to "FH" for designating one of panel memories 1 to 16 (corresponding to the preset switches 1 to 16) which are disposed in the working memory 21. The third byte of the same data contains rhythm-control-element setting data. The fourth byte contains a discrimination mark "F6H" indicative of the end if this preset data. In the rhythmcontrol-element setting data in the third byte, its most significant bit MSB is an empty (non-used) bit, the second to third bits corresponding to mode data ("0": NORMAL, 1:FILL-IN, and 2: BREAK), the fourth and fifth bits respectively corresponding to flags for fill-in variations and variations, and the sixth to eight bits corresponding to rhythm number data.

Referring back to FIG. 1, the conversion table 20 stores therein various tables, for example, the aforementioned menu selecting table shown in FIG. 12, which are used in order to execute data conversion when the CPU 11 performs various arithmetic operations.

The working memory 21 shown in FIG. 1 is a memory for temporarily storing various data generated when the CPU 11 executes the aforementioned control program, and is constituted, for example, by a random access memory (RAM) which includes a panel memory area, various registers and registers such as flags and buffers.

As shown in FIG. 6, the panel memory area includes thirty three areas having the same formats which store the states of the respective switches and control elements on the operation panel (FIG. 2), that is a memory area for a current-panelstate buffer CURRENT, memory areas PRENi (i="1" to "16") for a NORMAL PRESET mode and memory areas PRESi (i="1" to "16") for a SEQUENCER mode. In this panel memory area, the areas PRENi and the areas PRISi are separately used in the NORMAL (sequencer-off) mode (SEQ="0") and in the SEQUENCER mode (SEQ="1"), respectively, thereby enabling the reproduction of the panel state when the sequence has been programmed. This is because, unless two sets of memory areas are prepared, if presetting is rewritten, the previous panel state cannot be reproduced. On the other hand, in the case where the contents of the preset in the sequence need to be changed, the SEQUENCER mode is switched on by the switch 41 shown in FIG. 2 (SEQ="1" is selected) and the preset state may be rewritten into a desired state.

The following registers are provided in the working memory 21. In the following description, unless otherwise specified, the respective registers are represented by their own contents (such as data).

Figure 7:
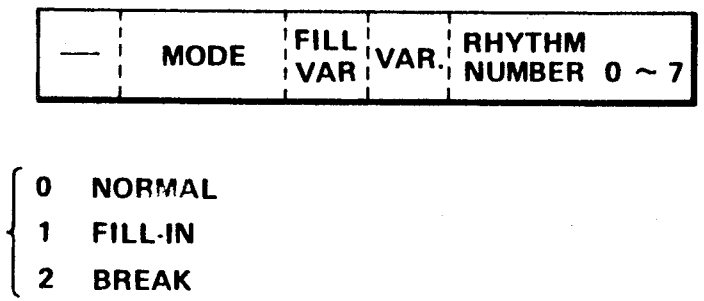
FIG. 7 is an illustration showing the format of the rhythm data buffer incorporated in the embodiment of FIG. 1.

RUN: a run flag, a rhythm running state ("1"/"0")
TCL: tempo clocks, "0" to "47"
BAR: the number of bars, "1" to "255"
BEAT: the number of beats, "1" to "4"
CNT: a beat counter for the sequencer, "1" to "4"
ROOT: a root, "0" to "11" (C, C#, ...,B)
PROOT: a root for a base tone, "0" to "11"
TYPE: a chord type, "OH" to "FH"
MODE:
"0" for NORMAL
"1" for PLAY MODE CHANGE
"2" for REAL-TIME WRITE
"3" for STEP WRITE
MENU: the current position of the multi-menu shown in FIG. 3, "1" to "9"
FLAGi: flags in the following respective modes
i="1", the chord sequence
i="2", the preset sequence
i="3", the repeat
i="4", the tone of performance of the lower keyboard enabled
ON (="1")
OFF (="0")
LEN: note-length data for the sequencer, "D1H" to "D3H"
LENGTH: the lower-order 4 bits of the sequencer note-length data LEN, "1" to "3"
DT, DEC: control variables ("1", "2" and "4") used for arithmetic operations on the number of beats
BRANCH: an attribute sign of the data for the sequencer
LONG: whether the chord of the sequencer is a fractional chord (="1") or not (="2")
SEQ: the sequencer is ON (="1") / OFF (="0")
CHDCHG: a flag indicative of the fact that a chord has been changed into another chord
PRECHG: a flag indicative of the fact that a preset state has been changed
SEQPNT: an address pointer for the sequencer
REMAIN: the remaining capacity of the sequencer, "0" to "200" (×10 bytes)
PRENO: the number of the preset memory area which has finally been set, "0" to "15" (corresponding to the switches 1 to 16)
RHYNO: rhythm numbers, "0" to "7" (corresponding to the switches 1 to 8)
RHYBUF: rhythm data buffer (refer to FIG. 7) having the same format as that of the third byte of the preset data shown in FIG. 4

The tempo clock generator 22 is constituted, for example, by a variable frequency) oscillator or a fixed frequency oscillator and a frequency divider having a variable division ratio for dividing the output from the oscillator to generate a tempo clock, thereby generating a tempo clock having a cycle equivalent to one twelfth of one bar (a quarter note). The cycle of the tempo clock can be varied by a tempo setting lever, a volume or a switch (not shown) which is disposed on the operation panel.

The tone generator (UK.TG) 23 for the upper-keyboard tones generates a melody tone signal in accordance with the operation of the upper keyboard 13. The tone generator (LK.TG) 24 for the lower-keyboard tones generates an accompaniment tone signal based in the form of a sustained tone in accordance with the operation of the lower keyboard 14. The tone generator (PK.TG) 25 for of the pedal-keyboard tones generates a base-tone signal in response to a key depression on the pedal keyboard 15, the musical-performance data (the chord-1 and the chord-2) which is sequentially read from the sequence memory 19 at a tempo determined by the aforementioned tempo clock, and the accompaniment pattern which is sequentially read from the pattern memory 18. The tone generator (RC.TG) 26 for the rhythmic chords generates a rhythmic-chord tone signal in which a chord designated by the aforementioned musical-performance data is rhythmized in accordance with the aforesaid accompaniment pattern. The tone generator (RHY.TG) 27 for generating the tone of each rhythm generates a rhythm tone signal in accordance with a rhythm pattern which is sequentially read from the aforesaid pattern memory 18 together with the accompaniment pattern.

The signals which have been generated by the respective tone generators 23 to 27 are supplied to a sound system (not shown) in which they are acoustically mixed with one another and are thus produced as a musical tone.

It should be noted that the illustrated electronic musical instrument is separately provided with the tone generator 23 for generating signals representative of the tones of the musical performance on the upper keyboard 13 and the tone generator 26 for generating signals representative of the tones of the automatic accompaniment. This arrangement enables the simultaneous generation of the tones of an accompaniment played through the keyboard and the tones of an accompaniment automatically played in respective tone colors independent of each other, so that it is possible to perform a music further full of variety.

The operation of the electronic musical instrument shown in FIG. 1 will now be described with reference to the flow charts of FIGS. 8 to 11 and 13 to 27.

1. Main Processing

Figure 8:
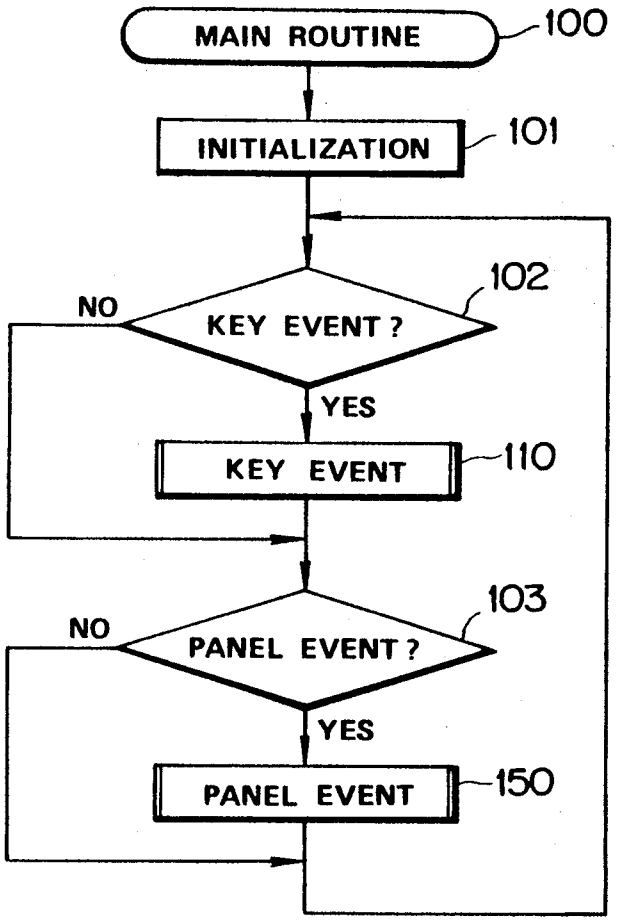
FIG. 8 is a flow chart of the main processing executed by the CPU 11 of the embodiment of FIG. 1.

Referring now to FIG. 8, when electric power is supplied to this electronic musical instrument, the CPU 11 starts to operate in accordance with the control program stored in the program memory 17 (Step 100). In Step 101, the CPU 11 clears a mode register MODE in the working memory 21, and sets a menu number register MENU to "1". Moreover, after the CPU 11 has displayed an initialization menu (for example, MENU="1" shown in FIG. 3) on the menu display unit 31 and thus has initialized the whole portions of this instrument, the CPU 11 executes the processing of the main routine composed of Steps 102, 110, 103 and 150.

First, in Step 102, the CPU 11 checks (or scans) the outputs from the keyboards 13 to 15, and judges whether or not the state of a key on any one of the keyboards 13 to 15 has been changed (a key event is present). If any key event is present, the CPU 11 executes the key event processing (Step 110) shown in FIG. 9, and the processing proceeds to Step 103. If no key event is present, the processing branches directly to Step 103. In Step 103, the CPU 11 scans the respective switches 32 to 71 and the control elements 80 on the operation panel, and judges whetter or not the state of any one of the switches 31 to 71 or the control elements 80 has changed (a panel event is present). If any panel element is present, the CPU 11 executes the panel event processing shown in FIG. 10 (Step 150), and then returns its control to Step 102. Subsequently, the CPU 11 repeats the aforesaid operation starting from Step 102. If no panel event is present, the processing returns directly to Step 102.

Key Event Processing

Figure 9:
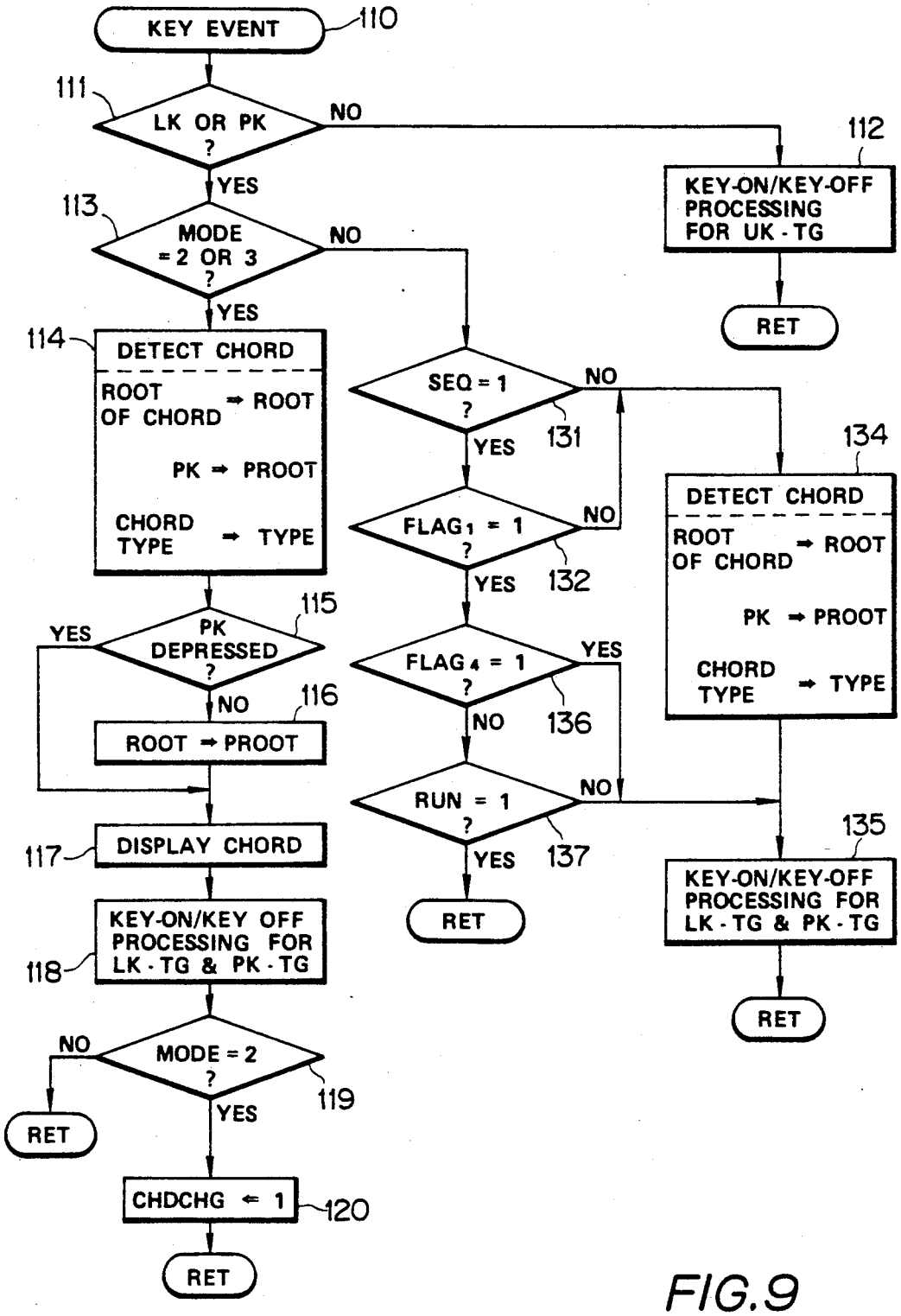
FIG. 9 a flow chart of the key-event processing executed by the CPU 11 of the embodiment of FIG. 1.

Referring to FIG. 9, in Step 111, the CPU 11 judges whether or not the above key event is based on the operation of the lower keyboard 4 and/or the pedal keyboard 15. If the answer is "NO", this means that the upper keyboard 15 has been operated, so that the processing proceeds to Step 112. In Step 112, the CPU 11 executes the key-on processing or the key-off processing for the tone generator (UK.TG) 23 in accordance with the kind of the above key event, and then the processing returns to the main processing (Step 103 shown in FIG. 8). Through this processing in Step 112, the tone of a melody is produced in accordance with depressions of keys on the upper keyboard 13 manual musical performance).

If it has been judged in Step 111 that the above key event is based on the operation of either the lower keyboard 14 or the pedal keyboard 15, the CPU 11 judges in Step 113 whether the current operation mode is the RECORD mode (MODE="2" or "3") or the PLAY mode. If the current operation is in the RECORD mode, the CPU 11 makes the processing proceed to Step 114, in which the CPU 11 detects the name of the current chord on the basis of the state of the key depressed on the lower keyboard 14, and stores the root of the thus-detected chord in the root register ROOT and the chord type corresponding to the detected chord in the chord-type register TYPE. The CPU 11 also stores in the pedal root register PROOT the tone of the key which is being depressed on the pedal keyboard 15. It should be noted that, if no key is depressed on the pedal keyboard 15 during this time, the CPU 11 transfers the root data from the register ROOT to the register PROOT (Step 115 and 115). In the next Step 117, the CPU 11 displays the name of the thus-obtained chord on the multi-menu display unit 31 (refer to the example of display of MENU="9" shown in FIG. 3). In Step 118, the CPU 11 executes the key-on/key-off processing for the tone generators LK.TG 24 and PK.TG 25, that is, the key processing of the tones of keys which have been depressed on the lower keyboard 14 and the pedal keyboard 15. Moreover, in Step 119, the CPU 11 judges whether the operation mode is the REAL-TIME WRITE mode (MODE="2") or whether the mode is the STEP WRITE mode (MODE="3"). If the answer is the STEP WRITE mode, the processing returns directly to the main processing (Step 103 shown in FIG. 8). If the answer is the REAL-TIME WRITE mode, the CPU 11 sets the chord change flag CHDCHG in Step 120 to "1", and the processing is then returned to the main processing (Step 103 shown in FIG. 8).

If it has been judged in Step 113 that the operation mode is the PLAY mode, the CPU 11 checks the sequencer flag SEQ in Step 131. If the sequencer is ON (SEQ="1"), the CPU 11 further checks the chord sequence flag $FLAG_1$ in Step 132. If SEQ is "0" (the NORMAL PLAY mode) or if the instrument is in a mode ($FLAG_1$="0") in which, even if SEQ="1", the sole preset sequence is ON and no chord sequence (no automatic accompaniment) is executed, the CPU 11 makes the processing proceed to Step 134. In Step 134, the CPU 11 detects the chord concerned on the basis of the state of the key depressed on the lower keyboard 14, and stores the root and the type of the chord respectively into the root register ROOT and the chord-type register TYPE. In addition, after storing the data representative of the tone of the key depressed on the pedal keyboard 15 into the pedal root register PROOT, the CPU 11 executes the key-on/key-off processing of the tone generators LK.TG 24 and PK.TG 25 in Step 135. Specifically, the CPU 11 causes the tone of the accompaniment to be generated in accordance with depression of keys on the lower keyboard 14, and causes the bass tone to be generated based on the chord type obtained from the lower keyboard 14 and the root of the key which has been depressed on the pedal keyboard 15.

On the other hand, if SEQ="1" and $FLAG_1$="1" (the chord sequence is ON) are established in Steps 131 and 132, the CPU 11 checks in Step 136 whether or not the LK ENABLE mode is ON ($FLAG_4$="1"). If the LK ENABLE mode is OFF ($FLAG_4$ ="0"), the CPU 11 further checks in Step 137 whether or not the automatic musical performance is running (RUN="1"). If the LK ENABLE mode is ON, that is, if the instrument is in a mode in which the tone of the musical performance made on the lower keyboard 14 is to be produced, or if the automatic musical performance is stopped even if the LK ENABLE is OFF, the processing proceeds to Step 135 in which the CPU 11 causes tones to be generated in accordance with the performance made on the lower keyboard 14. Also, if the LK ENABLE mode is OFF and if the automatic musical performance is running, the CPU 11 makes the processing return to the main processing (Step 103 shown in FIG. 8) without executing the tone generation processing. Specifically, in this case, only the rhythmic chord is produced as the tone of the accompaniment (the lower keyboard).

3. Panel Event Processing

Figure 10:
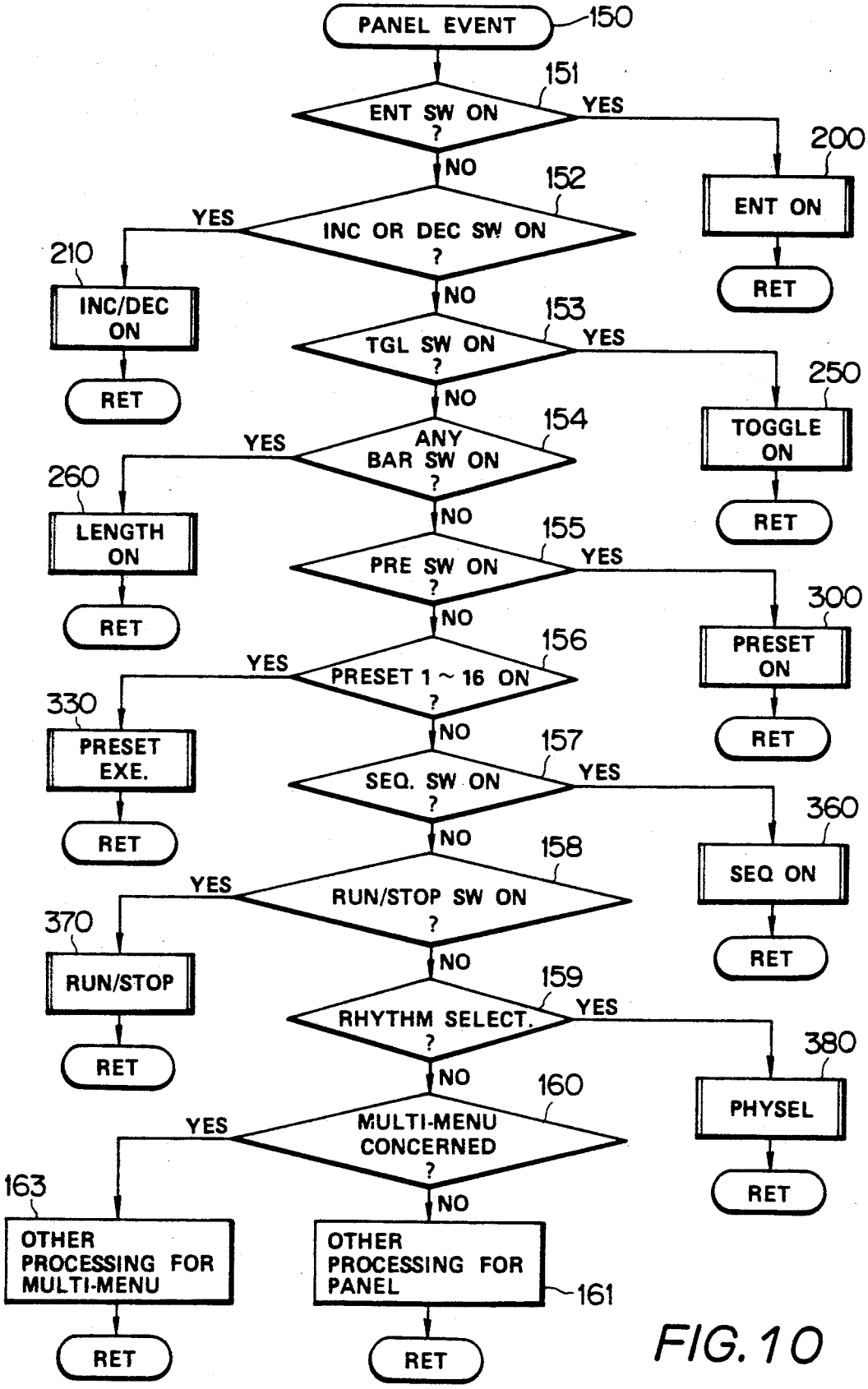
FIG. 10 is a flow chart of the panel-event processing executed by the CPU 11 of the embodiment of FIG. 1.

If any panel event is detected in Step 103 shown in FIG. 8, the CPU 11 carries out the panel event processing shown in FIG. 10. Specifically, in the respective Steps 151 to 160, the CPU 11 judges which of the switches 31 to 71 or the control elements 80 has been operated, and executes a suitable processing in accordance with the switch or control element thus operated.

4. ENT Switch-On Processing

When the ENT switch 34 is turned on, the processing proceeds from Step 151 of FIG. 10 to Step 200 of FIG. 11. The CPU 11 first judges in Step 201 whether the automatic musical performance is being performed. If the musical-performance mode has been switched over when the automatic musical performance is running, there is a risk of badly affecting the musical performance. Therefore, the operation of this ENT switch 34 is ignored as an operation error, that is to say, the CPU 11 executes no processing and makes the processing return to the main processing (Step 102 of FIG. 8).

On the other hand, if the automatic musical performance is not running, the CPU 11 replaces the contents of the menu number register MENU with the data TBLED in the menu select table (FIG. 12). This menu select table is formed so that the selection of the operation mode described previously with reference to FIG. 3 may be carried out. If the present menu MENU is "1", when the ENT switch 34 is turned on, the menu is switched to a new menu "2" which is a value of the data TBLED. Similarly, the menus 2, 8 and 4 to 9 are switched to 4, 8 and 1, respectively.

Subsequently, in Steps 220 to 229 of FIG. 13, the CPU 11 alters the sequencer flag SEQ and the contents of the mode number register MODE in accordance with the contents of the register MENU. Specifically, in Steps 221 to 224, the CPU 11 checks the number of the new menu MENU, and, if this new menu is MENU="1" to "3", the CPU 11 rewrites, in Step 225, the contents of the register MODE into "0" which is representative of the NORMAL mode, and resets the flag SEQ (indicating the fact that the sequencer is OFF). If this new menu is MENU="4" to "7", the CPU 11 rewrites the contents of the register MODE into "1" (PLAY MODE CHANGE), and sets the flag SEQ (the sequencer is ON) in Step 226. If MENU is "8", the CPU 11 rewrites the contents of the register MODE into "2" in Step 227 (REAL-TIME WRITE mode), and sets the flag SEQ. If MENU is "9", the CPU 11 rewrites the contents of the register MODE into "3" in Step 228 (STEP WRITE mode), and sets the flag SEQ (the sequencer is ON). If the new menu takes a value other than MENU "1" to "9", the CPU 11 sets the value of another mode. After completion of the rewriting of the register MODE and the setting and resetting of the flag SEQ, the CPU 11 carries out the mode display renewal processing (FIG. 14) in Step 230.

Figures 13, 14, 15:
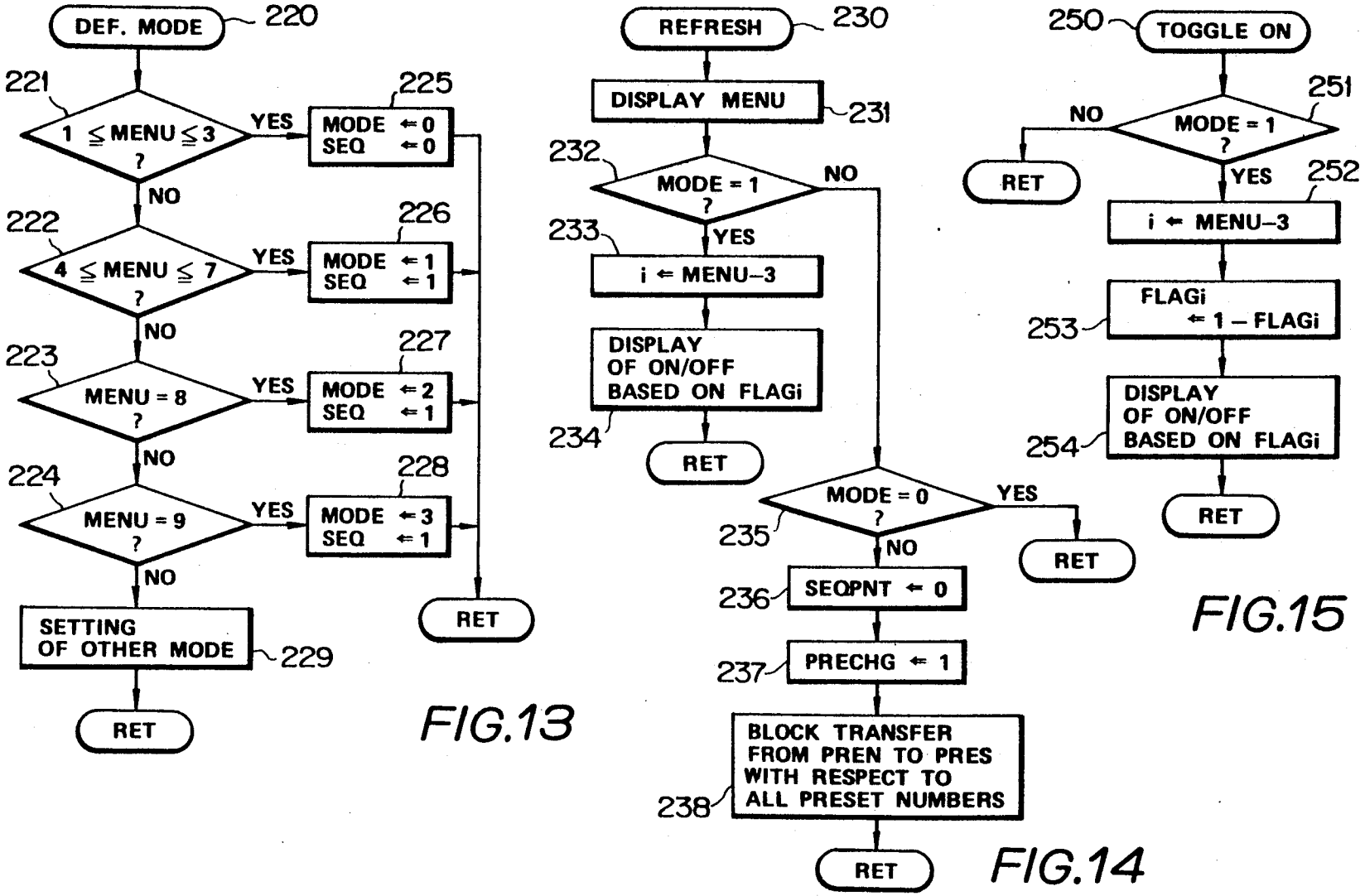
FIG. 13 is a flow chart of the mode change processing executed by the CPU 11 of the embodiment of FIG. 1.
FIG. 14 is a flow chart of the mode display refreshment processing executed by the CPU 11 of the embodiment of FIG. 1.
FIG. 15 is a flow chart of the toggle switch-on processing (TGL switch on processing) of the program executed by the CPU 11 of the embodiment of FIG. 1.

Referring to FIG. 14, in Step 231, the CPU 11 displays the new menu on the menu display unit 31. In Step 232, the CPU 11 judges whether or not MODE is "1", i. e., whether the new menu is in the state of PLAY MODE CHANGE (MENU="4" to "7" ). If any of the PLAY MODE CHANGE states is selected, the CPU 11 displays, in Steps 233 and 234, the contents (ON/OFF) of the ON/OFF flag FLAGi (i=MENU−3) of the corresponding menu on the aforesaid menu display unit 31.

If MODE is not "1" in Step 232, the CPU 11 determines, in Step 235, whether or not MODE="0" is established. If MODE is "0" (the NORMAL mode), the processing is returned directly to the main processing (Step 102 of FIG. 8).

If MODE is neither "0" nor "1", the new menu indicates the RECORD mode (MENU="8" or "9"), the CPU 11 clears the address pointer SEQ for the sequencer memory (Step 236), sets the preset change flag PRECHG (Step 237), and effects block transfer of the contents of the panel memory from the NORMAL areas to the SEQUENCER PRESET areas with respect to all the preset numbers PRENO (Step 238). After thus bringing the instrument into the RECORD mode in this manner, the CPU 11 returns its control to the main processing (Step 102 of FIG. 8).

5. INC/DEC Switch-On Processing

When the INC switch 32 or the DEC switch 33 has been turned on, the processing proceeds from Step 152 of FIG. 10 to Step 210 of FIG. 11. In the same manner as the case of the aforesaid ENT switch 3( being turned on, the operation of any switch is ignored during the automatic musical performance. If the automatic musical performance is not being made, the CPU 11 changes the contents of the menu number register MENU into the data TBLINC in the menu select table (FIG. 12) in response to the ON state of the INC switch 32 and into the data TBLDEC in the same table in response to the ON state of the DEC switch 33. The processing in Steps 221 to 238 performed after completion of the change of the data MENU are completely the same as the case of the ENT switch being turned on.

6. TGL Switch On Processing

When the TGL switch 35 has been turned on, the processing proceeds from Step 150 of FIG. 10 to Step 250 of FIG. 15. In Step 251, the CPU 11 makes judgment as to the operation mode. If the operation mode is the PLAY MODE CHANGE (MENU="4" to "7"), the CPU 11 toggles (inverts) the contents (ON/OFF) of the flag FLAGi (i=MENU−3) in Steps 252 to 253, displays a new ON/OFF state on the menu display unit 31 in Step 254, and then returns its control to the main processing (Step 102 shown in FIG. 8)

On the other hand, if the operation mode is not the PLAY MODE CHANGE (MODE is not "1"), the ON state of this TGL switch 35 has no meaning or is due to an operation error. Therefore, the CPU 11 executes no processing, and returns its control to the main processing (Step 102 of FIG. 8)

7. Note-Length Switch-On Processing

Figure 16:
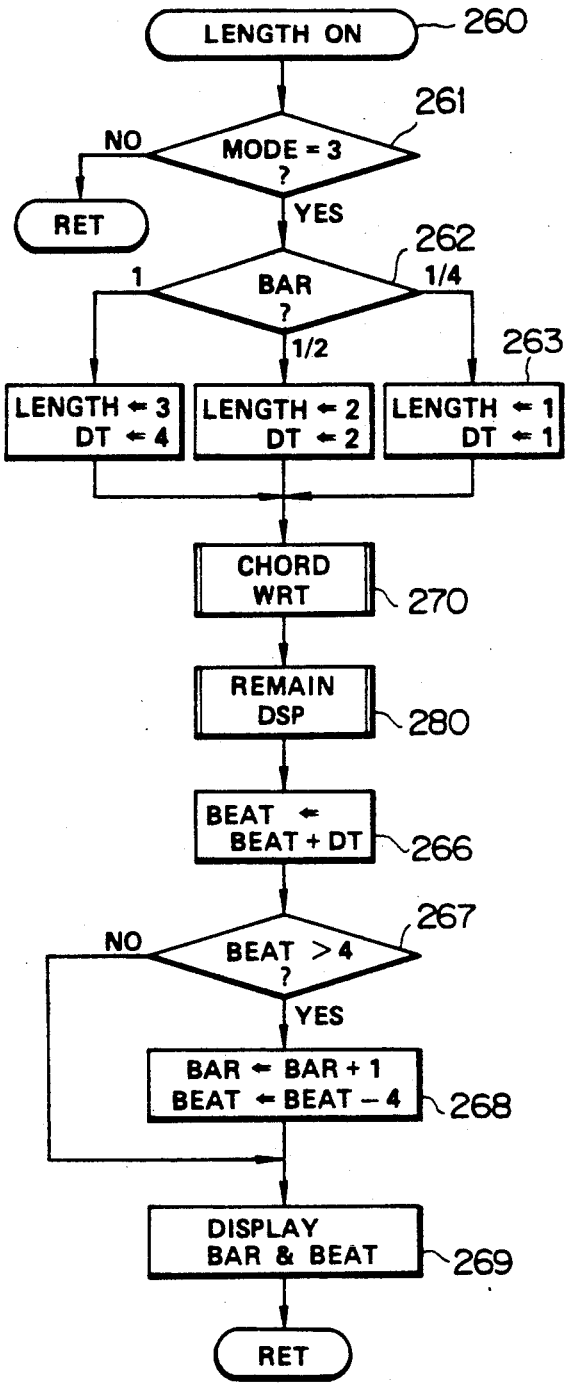
FIG. 16 is a flow chart of the tone-length switch-on processing executed by the CPU 11 of the embodiment of FIG. 1.

When any of the note-length switches 37 to 39 has been turned on, the processing proceeds from Step 154 of FIG. 10 to Step 260 of FIG. 16. The CPU 11 judges, in Step 261, whether or not the operation mode is the STEP WRITE mode (MODE="3"). Since the note-length switches are used solely in the STEP WRITE mode, the CPU 11 executes no processing in any mode other than the STEP WRITE mode, and the processing of the CPU 11 returns to the main processing (Step 102 of FIG. 8).

Figure 17:
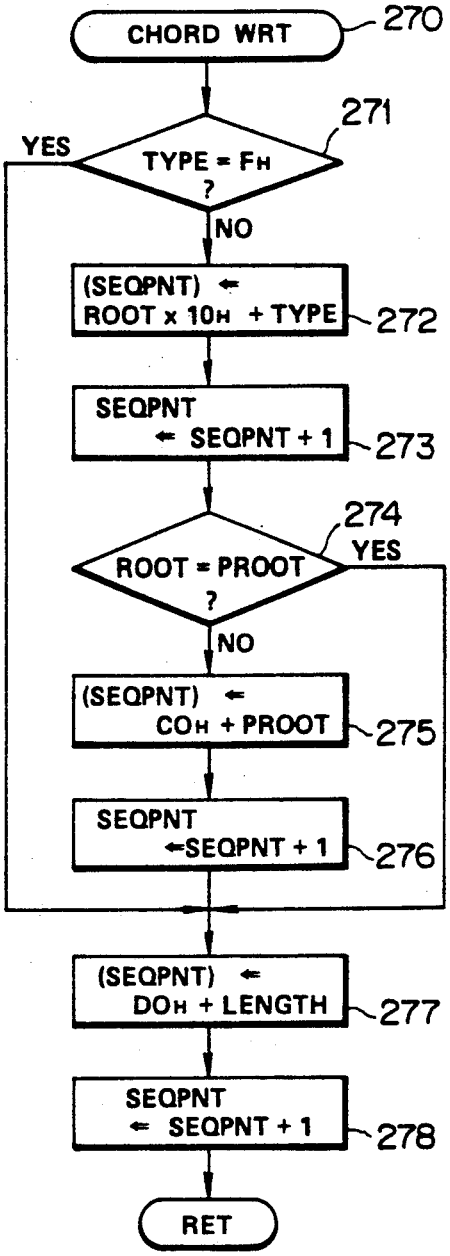
FIG. 17 is a flow chart of the chord write processing executed by the CPU 11 of the embodiment of FIG. 1.

When the CPU 11 has confirmed that the operation mode is the STEP WRITE mode in Step 261, the CPU 11 judges, in Step 262, which of the note-length switches has been turned on. In Step 263, the CPU 11 s&ores the note-length data corresponding to the thus-detected note-length switch, which has been turned on, in the note-length data register LENGTH, and stores a control variable in a beat-number calculating variable register DT. Subsequently, the CPU 11 writes chord data into the sequencer memory 19 by a CHORD WRITE processing of Step 270 (FIG. 17). The CPU 11 then displays the remaining memory capacity of the sequencer memory 19 on the menu display unit 31 by the memory remaining capacity display processing of Step 280 (FIG. 18), and then the processing proceeds to Step 266. In Step 266, the aforesaid control variable DT is added to the contents of the beat-number counter BEAT. In Step 267, the CPU 11 judges whether or not this beat number BEAT exceeds four beats (one bar). If the beat number does not exceed one bar, the processing proceeds directly to Step 269. If the beat number BEAT exceeds one bar, the CPU 11 subtracts, in Step 268, "4" from this beat number BEAT and advances (or increments) the bar counter BAR. Subsequently, the CPU 11 displays these new numbers of the bar and the beat on the menu display unit 31 in Step 269. Then, the processing returns to the main processing (Step 102 of FIG. 8).

8. Chord Write Processing

Referring to FIG. 17, in Step 271, the CPU 11 checks the chord type TYPE which has been detected in Step 114 of the aforesaid key event processing (FIG. 9) and stored in the chord-type register. If the chord is established (i.e., if TYPE is not "FH"), the CPU 11 writes, in Step 272, the contents of the root register ROOT and the chord type TYPE respectively into the higher-order four bits and the lower-order four bits of the address of the sequencer memory 19 designated by the pointer SEQPNT (the first byte of the chord-1 or the chord-2 of FIG. 4). In Step 273, the CPU 11 increments the pointer SEQPNT to designate the next write position (the second byte). In step 274, the root tone ROOT is compared with the base root tone PROOT. If these tones differ from each other, the data which is being written is a fractional chord (the chord-1 shown in FIG. 4), so that the CPU 11 writes 8-bit data for the aforesaid second byte in which the higher-order 4 bits correspond to a fractional chord discrimination mark "CH" and the lower-order 4 bits correspond to the base root tone PROOT (Step 275). Moreover, the CPU 11 increments the pointer SEQPNT in Step 276, and then writes 8-bit data for the third byte in which the higher-order 4 bits correspond to a note-length discrimination mark "DH" and the lower-order 4 bits correspond to the note-length data LENGTH (Step 277). In the next Step 278, the CPU 11 makes the pointer SEQPNT advance so as to set it to the top of the next word, and subsequently, returns the processing to the main processing (Step 102 of FIG. 8).

On the other hand, if the comparison result in Step 274 is ROOT=PROOT, this means that the data which is being written is the normal chord (the chord-2 shown in FIG. 4), so that Steps 275 and 276 are skipped. In Step 277, the CPU 11 writes the aforesaid data "DH" and LENGTH into the second byte. In the next Step 278, the CPU 11 makes the pointer SEQPNT advance so as the set it to the top of the next word, and subsequently, the processing returns to the main processing (Step 102 of FIG. 8).

If the check result in Step 271 represents a nonestablishment of the chord (TYPE="FH"), the data which is being written is data representative of a rest (the non-chord shown in FIG. 4), so that Steps 272 to 276 are skipped. In Step 277, the CPU 11 writes the note-length mark "DH" and the note-length data LENGTH into the first byte. In Step 278, the CPU 11 makes the pointer SEQPNT advance, and returns the processing to the main processing (Step 102 of FIG. 8).

9. Memory Remaining Capacity Display Processing

Figure 18:
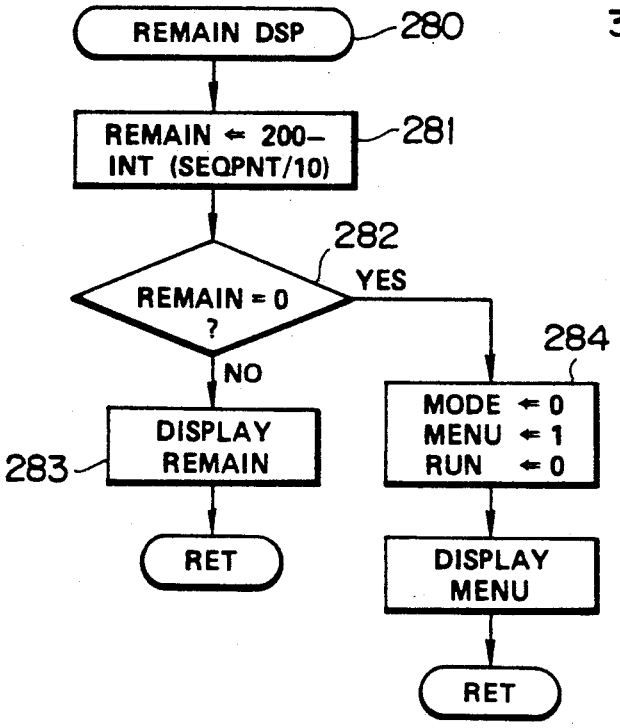
FIG. 18 is a flow chart of the memory remaining capacity display processing executed by the CPU 11 of the embodiment of FIG. 1.

Referring to FIG. 18, in Step 281, the CPU 11 divides the content of the address pointer SEQPNT by "10", calculates the integral portion of the value thus obtained, subtracts this integer portion from "200", and storing the value obtained as a result of this subtraction in the memory remaining capacity register REMAIN. This is done in order to display the rough value of the remaining capacity of the memory in units of 10 bytes since a 2000-byte memory is used as the sequencer memory 19. In Step 282, the CPU 11 judges whether or not the remaining capacity of &he memory has reached "0", and, if the answer is "No", the CPU 11 displays, in Step 283, the remaining capacity of the memory on the menu display unit 31. Subsequently, the processing returns to the main processing (Step 102 of FIG. 8).

On the other hand, if the remaining capacity of the memory reaches "0", the CPU 11 clears the mode number register MODE in Step 284, setting the menu number register MENU to "1", and resetting the run flag RUN to "0". After this, the CPU 11 displays the remaining capacity of the memory "0" on the menu display unit 31 in Step 285, and the processing is returned to the main processing.

10. PRE Switch-On Processing

Figure 19:
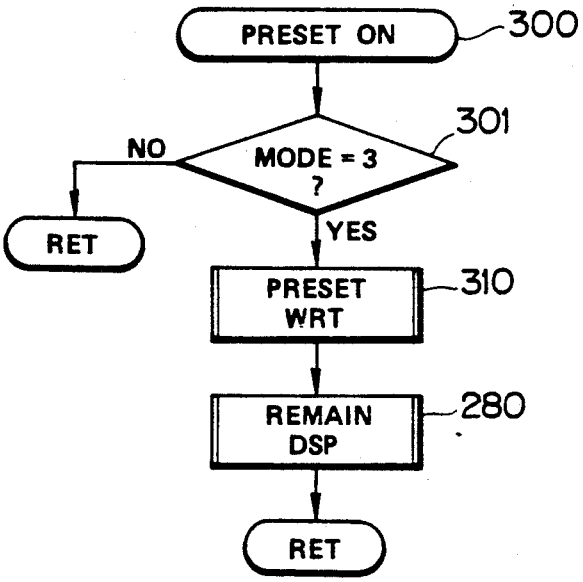
FIG. 19 is a flow chart of the preset write switch-on processing executed by the CPU 11 of the embodiment of FIG. 1.

When the preset write (PRE) switch 36 has been switched on, the processing proceeds from Step 155 of FIG. 10 to Step 300 of FIG. 19. In Step 301, the CPU 11 judges whether or not the operation mode is the STEP WRITE mode (MODE="3"). Since the PRE switch 36 is used solely in the STEP WRITE mode, the CPU 11 executes no processing in any modes other than the STEP WRITE mode, and returns the processing to the main processing (Step 102 of FIG. 8).

When it has been confirmed in Step 301 that the operation mode is the STEP WRITE mode, the CPU 11 executes the preset data write processing (FIG. 20) staring from Step 310. Moreover, the CPU 11 carries out the aforesaid memory remaining capacity display processing (FIG. 18), and the processing of the CPU 11 is then returned to the main processing (Step 102 of FIG. 8).

11. Preset Data Write Processing

Figure 20:
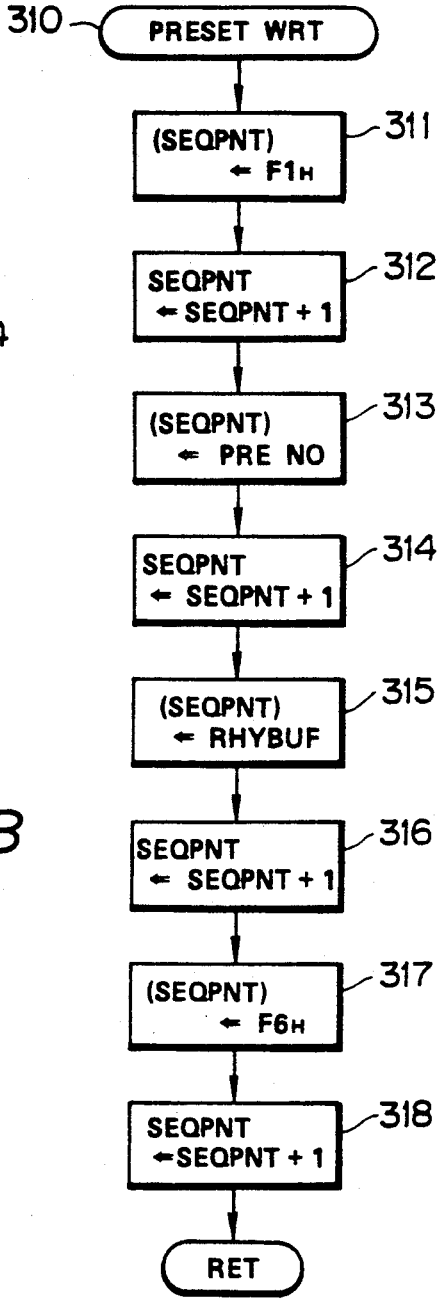
FIG. 20 is a flow chart of the preset write processing executed by the CPU 11 of the embodiment of FIG. 1.

Referring to FIG. 20, the CPU 11 writes, in Step 311, an 8-bit discrimination mark "F1H" indicative of the start of the preset data into the address of the sequencer memory 19 designated by the pointer SEQPNT (the first byte of the preset of FIG. 4). While the CPU 11 sequentially incrementing the pointer SEQPNT in Steps 312, 314 and 316, the CPU 11 writes the preset number PRENO into the second byte in Step 313, the contents of the rhythm buffer into the third byte in Step 315, an 8-bit discrimination mark "F6H" indicative of the end of the preset data into the fourth byte in Step 317. Moreover, the CPU 11 advances the pointer SEQPNT in Step 318 so as to set it to the top of the following word. Subsequently, the processing returns to the main processing.

12. Preset Exchange Processing

Figure 21:
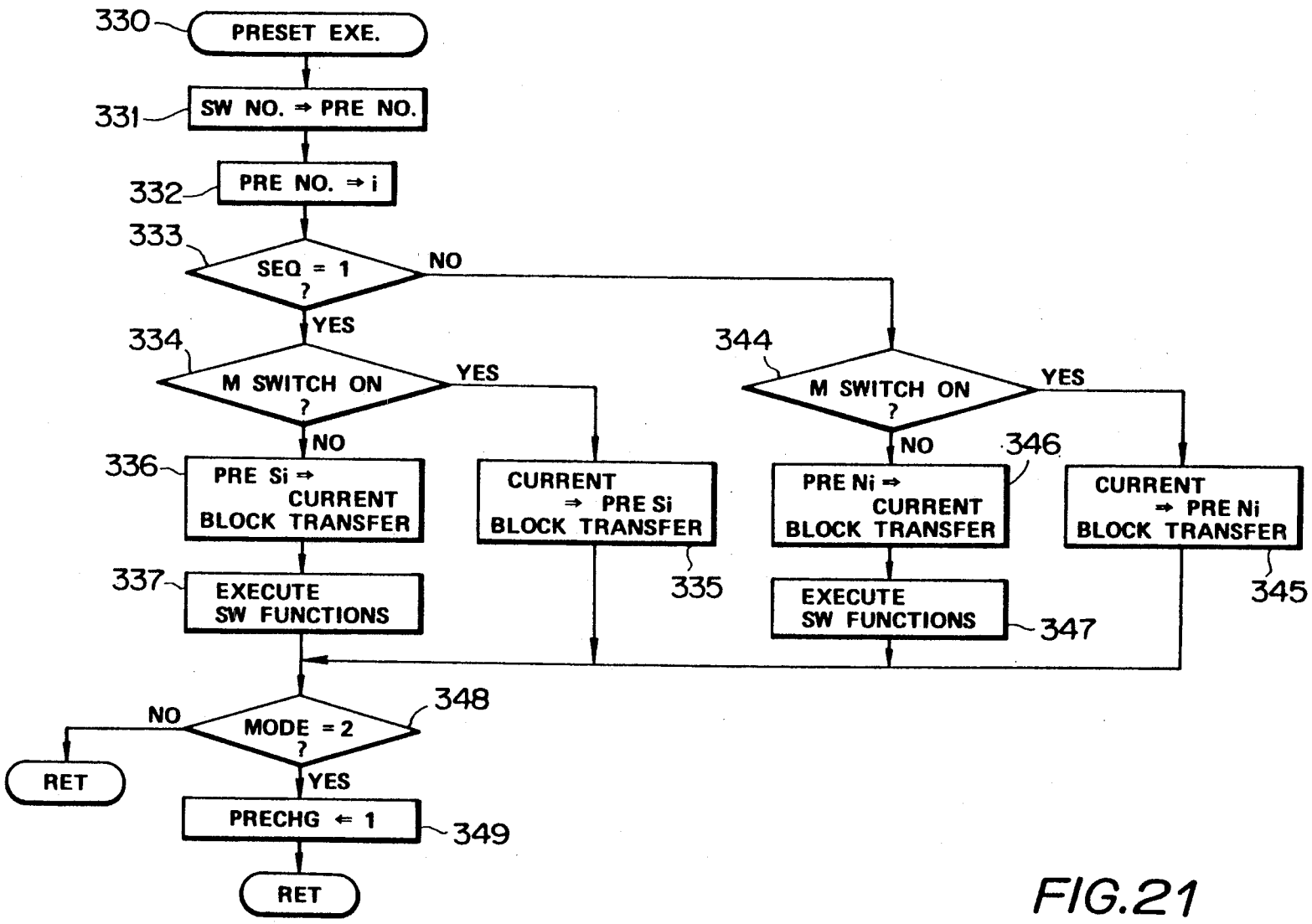
FIG. 21 is a flow chart of the preset change processing executed by the CPU 11 of the embodiment of FIG. 1.

When any one of the preset switches 55 to 70 has been turned on, the processing proceeds from Step 156 of FIG. 10 to Step 330 of FIG. 21. In Step 331, the CPU 11 stores, in the preset number register PRENO, the number (any one of "1" to "16") of the preset switch which has just been turned on. Moreover, in Step 322, the CPU 11 stores this number in an "i" counter, and checks the flag SEQ in Step 333. This is done because the areas PRENi and the areas PRESi are selectively used in the NORMAL mode (SEQ="0") and in the SEQUENCER mode (SEQ="1"), respectively.

More specifically, if SEQ is "1", the CPU 11 checks, in Step 334, whether or not the memory switch 71 has been turned on. If the memory switch 71 has been turned on, this means that the PANEL STATE RECORD mode is active. Therefore, in Step 335, the CPU 11 effects a block transfer, to the memory area PRESi, of the current panel state which is the content of the memory area CURRENT. If the switch 71 is not turned on, this means the PANEL STATE SETTING mode is active. Therefore, in Step 336, the CPU 11 effects a block transfer of the contents of the area PRESi to the area CURRENT, and, in Step 337, sets the respective switches and control elements to the states designated by the contents of the area CURRENT.

If the check result in Step 333 is SEQ="0", the CPU 11 executes, in Steps 344 to 347, the same processing as that of Steps 334 to 337, apart from the use of the areas PRENi instead of the memory area PRESi.

After completion of the processing in Steps 335, 337, 345 or 347, the CPU 11 judges, in Step 348, whether or not the current operation mode is the REAL-TIME WRITE mode (MODE="2"). If the mode is the REAL-TIME WRITE mode, the CPU 11 sets the preset change flag PRECHG to "1" in Step 349, and returns its control to the main processing. If it is not the REAL-TIME WRITE mode, the CPU 11 bypasses Step 349 and returns the control to the mail routine.

13. SEQ Switch On Processing

Figure 22:
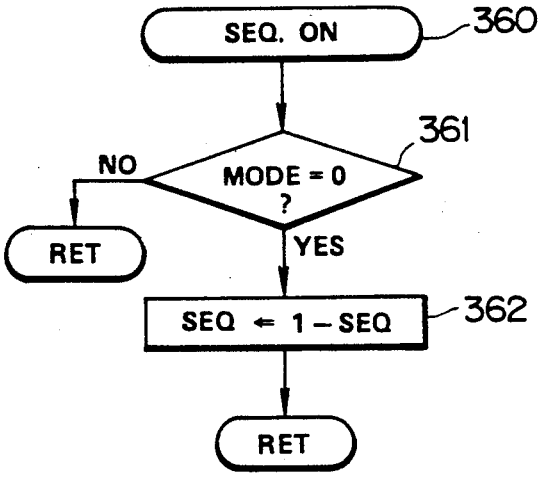
FIG. 22 is a flow chart of the sequencer switch-on processing executed by the CPU 11 of the embodiment of FIG. 1.

When the sequencer (SEQ) switch 41 has been turned on, the processing proceeds from Step 157 of FIG. 10 to Step 360 of FIG. 22. In Step 361, a judgment is made as to the operation mode. When the operation mode is any mode other than the NORMAL mode (i. e., when MODE is not "0"), the CPU 11 executes no processing. On the other hand, when the operation mode is the NORMAL mode (MODE is "0"), the CPU 11 toggles (inverts), in Step 362, the contents (ON/OFF) of the sequencer flag SEQ, and the processing returns to the main processing.

14. RUN/STOP Processing

Figure 23:
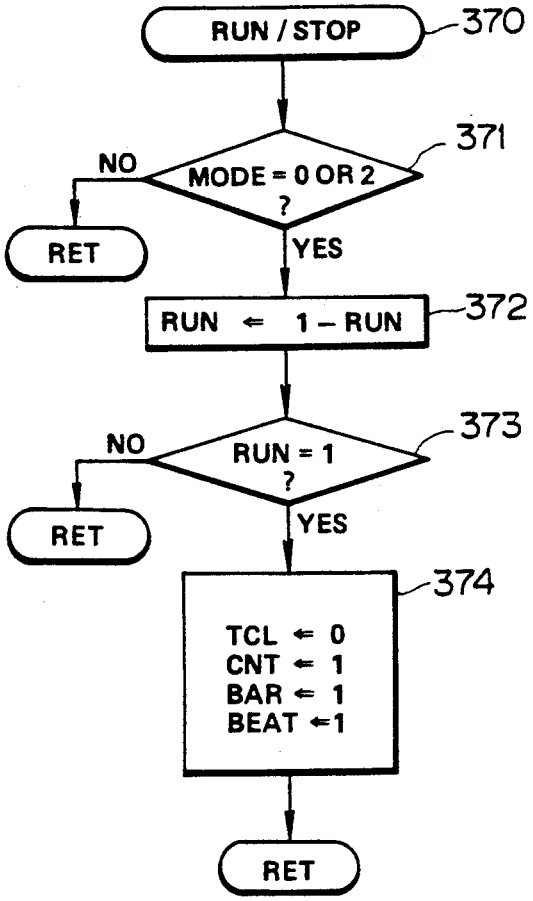
FIG. 23 is a flow chart of the run/stop processing executed by the CPU 11 of the embodiment of FIG. 1.

When the RUN/STOP switch 42 is turned on, the processing proceeds from Step 153 of FIG. 10 to Step 370 of FIG. 23. In Step 371, a judgment is made as to the operation mode. If the operation mode is any mode other than REAL-TIME RUNNING modes such as the NORMAL mode (MODE="0") or the REAL-TIME WRITE mode (MODE="2"), the CPU 11 executes no processing, and returns the control to the main processing.

On the other hand, if the operation mode is the REAL-TIME RUNNING mode, the CPU 11 toggles (inverts) the contents of the run flag RUN in Step 372, and checks the flag RUN after this inversion. If the running of the rhythm or the like has been stopped (RUN="0"), the processing returns directly to the main processing. If such running has been started (RUN="1"), the CPU 11 resets the tempo clock counter TCL to "0", and sets the bar counter BAR, the beat-number counter BEAT and the beat-number counted CNT for the sequencer to "1". Then, the processing is returned to the main processing.

15. Rhythm Select Processing

Figure 24:
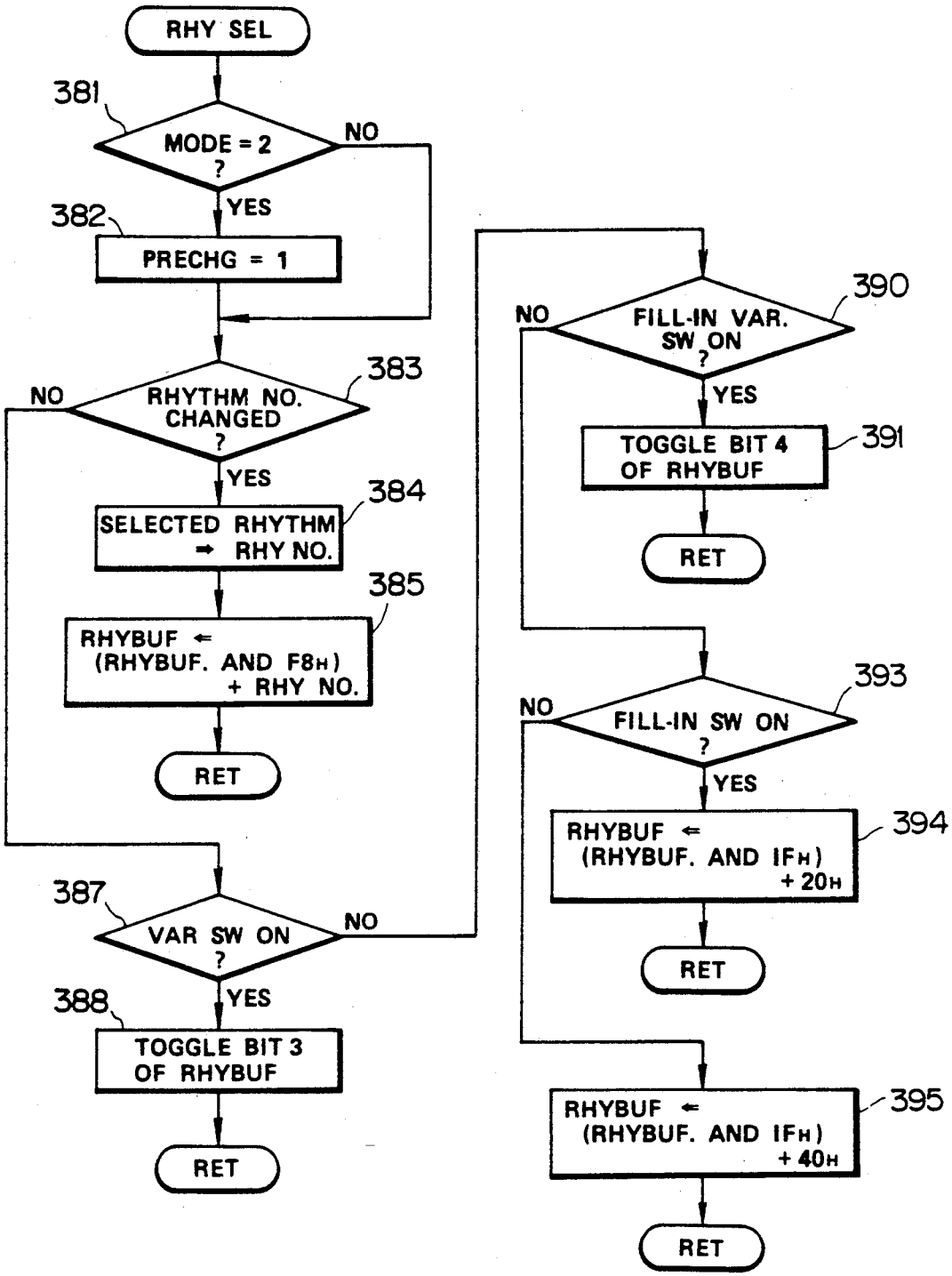
FIG. 24 is a flow chart of the rhythm selection processing executed by the CPU 11 of the embodiment of FIG. 1.

When any of the rhythm selection switches 43 to 54 has been turned on, the processing proceeds from Step 159 of FIG. 10 to Step 380 of FIG. 24. In Step 381, the CPU 11 judges whether or not the current operation mode is the REAL-TIME WRITE mode (MODE="2"). If the mode is the REAL-TIME WRITE mode, the CPU 11 sets the preset change flag PRECHG in Step 382, and the processing proceeds to Step 383. If the mode is not the REAL-TIME WRITE mode, the processing proceeds directly to Step 383.

In the processing continuing from Step 383, the CPU 11 checks the kind of the rhythm selection switch which has been turned on. The CPU 11 then executes the rewriting of the data into the rhythm data buffer RHYBUF (FIG. 7) in accordance with the results of the check.

Specifically, when any one of the rhythm select switches 43 to 50 has been turned on, the processing proceeds from Step 383 to Step 384, in which the CPU 11 stores the number of the thus-selected rhythm in the register RHYNO. In the next Step 385, the CPU 11 rewrites the lower-order 3 bits of the buffer RHYBUF into the new rhythm number RHYNO, and subsequently, returns its control to the main processing.

When the variation setting switch 51 has been turned on, the processing proceeds from Step 387 to Step 388. In Step 388, the CPU 11 inverts "1"/"0" in the fifth highest bit of the rhythm data buffer RHYBUF, and returns the control to the main processing.

When the fill-in variation setting switch 52 has been turned on, the processing proceeds from Step 390 to Step 391. In Step 391, the CPU 11 inverts "1"/"0" in the fourth highest bit of the rhythm data buffer RHYBUF, subsequently returning its control to the mail processing.

When the fill-in switch 54 has been turned on, the processing proceeds from Step 393 to Step 394. In Step 394, the CPU 11 rewrites the data in the higher-order 3 bits of the rhythm data buffer RHYBUF into "001" (binary) indicative of the fill-in operation, subsequently returning its control to the main processing.

When the break switch 53 has been turned on, the processing proceeds from Step 393 to Step 395. In Step 395, the CPU 11 rewrites the data in the higher-order 3 bits of the rhythm data buffer RHYBUF into "010" (binary) indicative of a break, subsequently returning the control to the main processing.

16. Tempo Interrupt Processing

Figure 25:
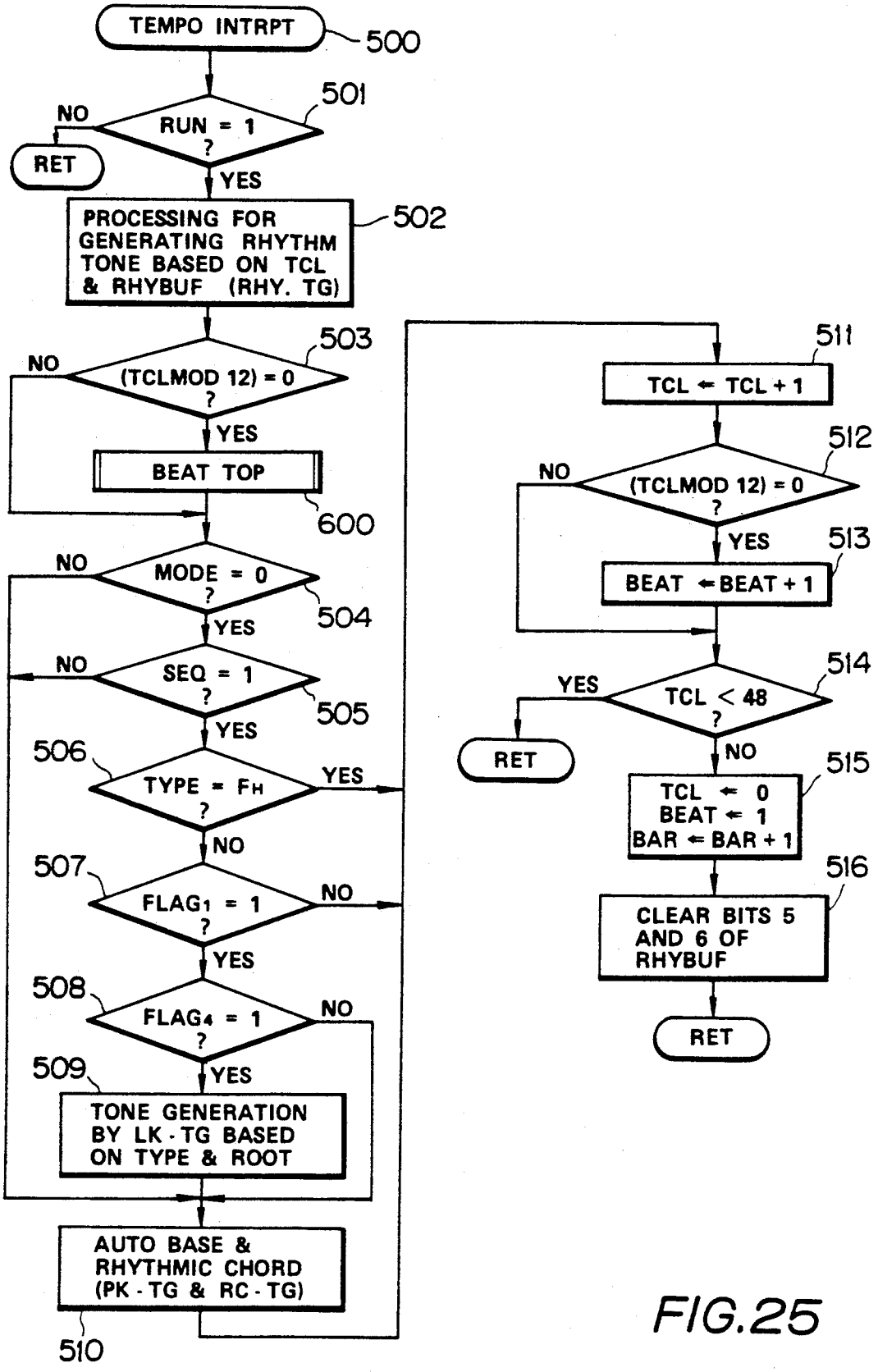
FIG. 25 is a flow chart of the tempo interrupt processing executed by the CPU 11 of the embodiment of FIG. 1.

This electronic musical instrument executes the following interrupt processing (Step 500) in response to the tempo clock generated by the tempo clock generator 22 as an interrupt signal. Referring to FIG. 25, the CPU 11 first checks the run flag RUN in Step 501. If RUN is "0", this means that no rhythm is currently running. (Therefore, the automatic accompaniment and the real-time writing of the accompaniment data are stopped.) Thus, the CPU 11 cancels the tempo interrupt routine, and returns the control to the previous routine.

On the other hand, as the result of the check carried out in Step 501, it is determined that RUN is "1", i. e., any rhythm is currently running, the processing proceeds to Step 502. In Step 502, the CPU 11 drives the tone generator (RHY.TG) for generating a rhythm tone on the basis of the contents of the tempo clock counter TCL and the rhythm data buffer RHYBUF, that is to say, carries out processing for generating a rhythm tone.

In the next Step 503, the CPU 11 divides a count value TCL of the tempo clock by "12", and checks whether or not the remainder of the division is "0". If the remainder is not "0", the processing proceeds to Step 504. Since the cycle of the tempo clock is one-twelfth of one bar, and therefore, if the remainder is "0", the current timing is positioned at the top of one beat (beat top). In this case, the CPU 11 executes the beat top processing starting from Step 600 (FIG. 26), and subsequently makes the processing proceeds to the next Step 504. In Step 504, the CPU 11 checks the operation mode, and, if the mode is the NORMAL mode (MODE="0"), the CPU 11 checks the flag SEQ in Step 505. If it is judged that the sequencer is ON (SEQ="1"), the CPU 11 checks the chord type TYPE in Step 506. If a chord is established (TYPE is not "FH"), the CPU 11 checks the flag $FLAG_1$ in Step 507. If it is determined that the chord sequence is ON ($FLAG_1$="1"), the CPU 11 further checks the flag $FLAG_4$ in Step 508.

In the case where the LK ENABLE mode is ON ($FLAG_4$="1"), that is, if the NORMAL mode is selected, the sequencer being ON, a chord being established, the chord sequencer being ON and the LK ENABLE mode being ON, the CPU 11 controls, in Step 509, the generation of tones by the tone generator LK.TG 24 on the basis of the chord type TYPE and the root ROOT. Moreover, in Step 510, the CPU 11 controls the generation of tones by the tone generators PK.TG 25 and RC.TG 26 on the basis of the count value of the tempo clock counter TCL, the root ROOT, PROOT and the data RHYBUF in the rhythm data buffer.

Specifically, in this case, the tone generator LK.TG 24 generates the tones of an accompaniment (chord) in accordance with depressions of the keys on the lower keyboard LK 14, and the other tone generators PK.TG 25 and RC.TG 26 generate the auto-base tones and the rhythmic chord tones, respectively, in accordance with the musical-performance data stored in the sequencer memory 19.

In the next Step 511, the tempo clock counter TCL is incremented, and, in Step 512, the CPU 11 judges whether or not the count value of the counter TCL is an integer-fold of "12". If the value is such an integer-fold, this means that the top of the following beat has been reached, so that the beat-number counter BEAT is advanced. If the aforesaid value is not such an integer-fold, the processing of Step 513 is skipped, and the processing proceeds to Step 514. In Step 514, the CPU 11 judges whether or not the count value of the tempo clock counter TCL is smaller than "48". If the value is smaller than "48", the CPU 11 cancels the tempo interrupt processing, and returns its control to the previous routine. On the other hand, if the count value of the counter TCL is greater than or equal to "48", this means that the current bar has been ended. Therefore, the CPU 11 clears the counter TCL in Step 515, setting the beat-number counter BEAT to "1", and making the bar counter BAR advance. Moreover, in Step 516, the CPU 11 clears the second and third highest-order bits of the rhythm data buffer RHYBUF (FIG. 7), thereby changing the rhythm mode to the NORMAL state. After this, the tempo interrupt processing has been canceled, and the processing returns to the previous routine It is to be noted that, in the previously-described Steps 504 to 508, if the operation mode is not the NORMAL mode (MODE is not "0"), if the sequencer is OFF (SEQ="0") even if the NORMAL is selected, or if the LK ENABLE mode is OFF ($FLAG_4$= "0"), the processing in Step 509 is not executed. More specifically, in this case, the tones according to a manual performance on the lower keyboard is not generated, but the auto-bass tones and that rhythmic chord tones are generated. Also, if no chord is established (TYPE="FH") or if the chord sequencer is OFF ($FLAG_1$="0"), Steps 509 and 510 are both skipped. In other words, none of the tones according to the manual performance on the lower keyboard, the auto-bass tones and the rhythmic chord tones are generated.

17. Beat Top Processing

When it has been found in Step 503 of FIG. 25 that the count value of the tempo clock counter TCL is an integer-fold of "12", that is, when an interruption of the tempo is effected with respect to the top of one bear, the following beat top processing is executed.

Figure 26:
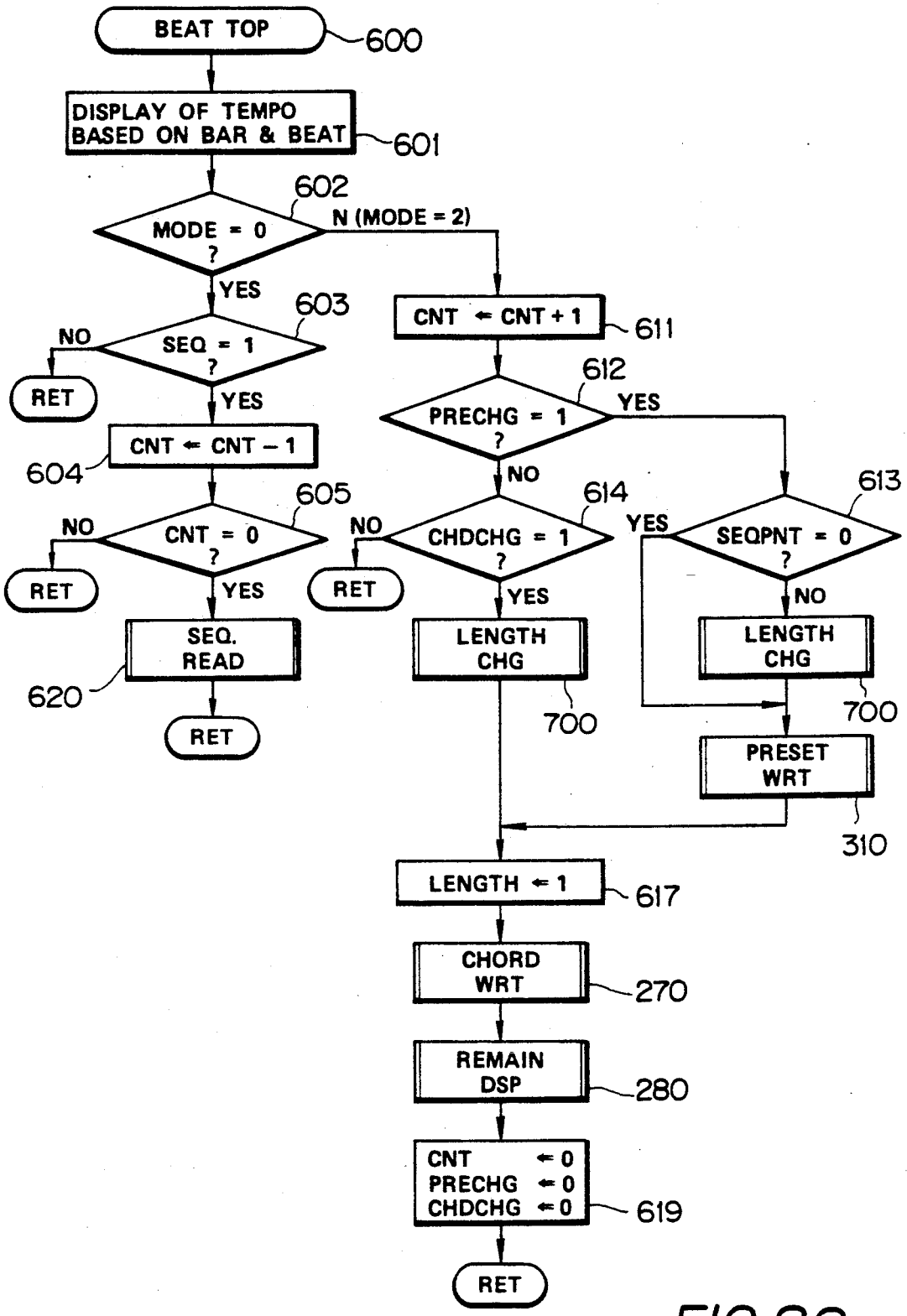
FIG. 26 is a flow chart of the beat top processing executed by the CPU 11 of the embodiment of FIG. 1.

Referring to FIG. 26, in Step 601, the CPU 11 displays the number of bars BAR and the number of beats BEAT on the tempo display unit 40. In the next Step 602, the CPU 11 checks the operation mode. In Step 602, if the current operation mode is the NORMAL mode (MODE="0"), the CPU 11 checks the flag SEQ in the ensuing Step 603. Since this beat top processing is conducted for the sequencer, if the sequencer is OFF (SEQ="0"), the CPU 11 executes no processing, canceling the above-described tempo interrupt processing, and returning its control to the previous routine.

If SEQ is "1" in Step 603, the sequencer counter CNT is decremented in Step 604. Subsequently, in Step 605, the CPU 11 judges whether or not the count value of the counter CNT has reached "0". If the value is not "0", the CPU 11 cancels the tempo interrupt processing, and returns the control to the previous routine. If the value is "0", the CPU 11 executes the sequencer readout processing (FIGS. 27(A) and 27(B)) which will be described later.

If the result of the check in Step 602 is any mode other than the NORMAL mode (MODE is not "0"), the processing proceeds from Step 602 to Step 611. This beat top processing is executed in the rhythm-running state (see Step 501 of FIG. 25), i. e., solely when MODE is "0" or "2". Therefore, if MODE="0" is not established, MODE="2" is established (the REAL-TIME WRITE mode). In Step 611, the sequencer counter CNT is advanced, and, in Step 612, the CPU 11 checks the flag PRECHG. The flag PRECHG is set when the operation mode is switched to the REAL-TIME WRITE mode (MODE="2") (Step 237 of FIG. 14), when the preset switches 55 to 70 are operated (Step 349 of FIG. 21), or when the rhythm selection switch is operated during the real-time write operation (Step 382 of FIG. 24). If PRECHG is "1", the processing proceeds to Step 613. If PRECHG is "0", the processing proceeds to Step 614.

Figure 29:
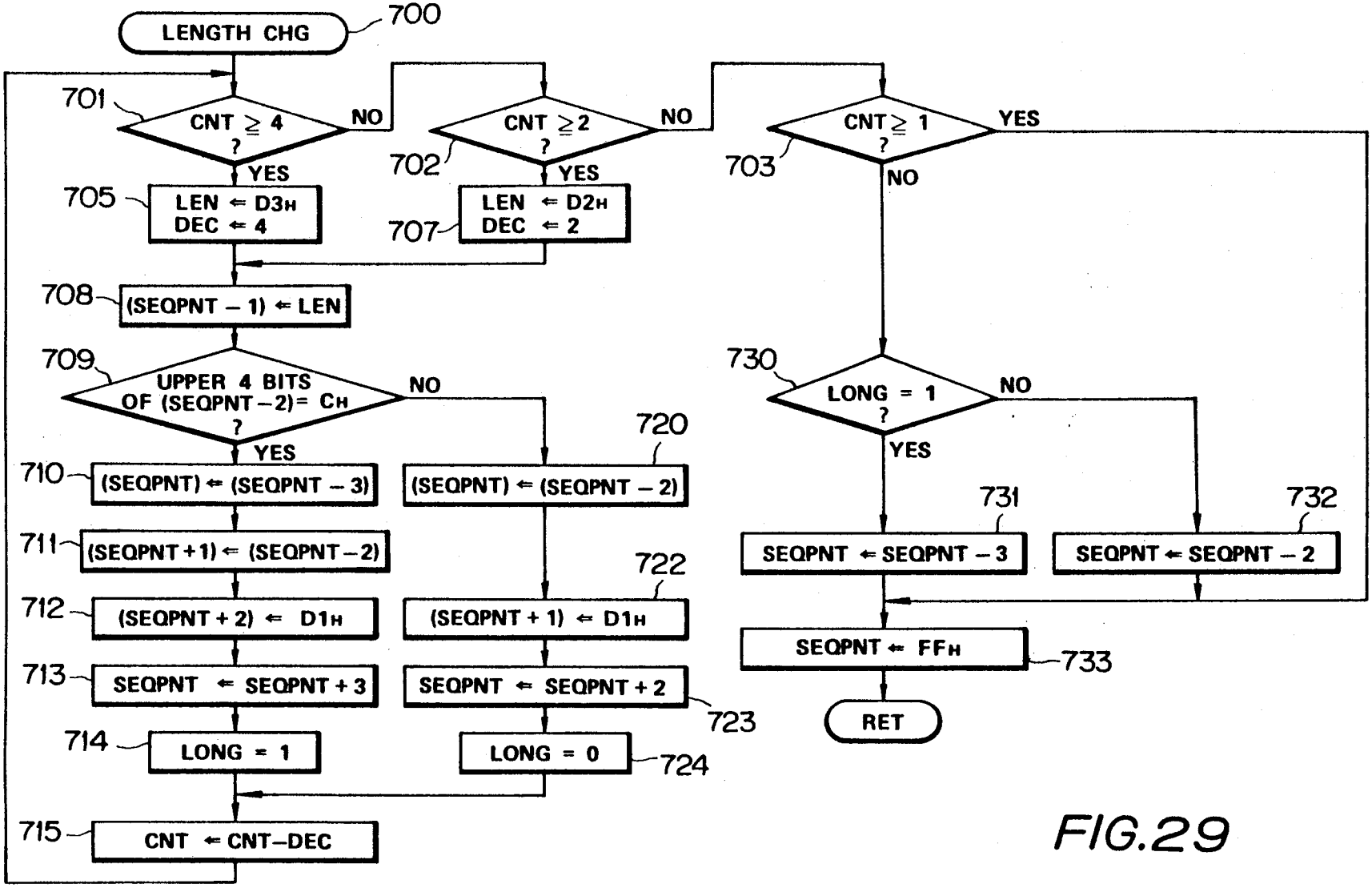
FIG. 29 is a flow chart of the tone-length change processing executed by the CPU 11 of the embodiment of FIG. 1.

In Step 613, the CPU 11 judges whether or not the sequencer pointer SEQPNT has been cleared. If SEQPNT is not "0", the CPU 11 executes the note-length change processing starting from Step 700 (FIG. 29). Moreover, the CPU 11 executes the previously-described preset write processing (Step 310 of FIG. 20). The processing then proceeds to Step 617. On the other hand, if SEQPNT is "0", the processing starting from Step 700 is skipped, and the CPU 11 directly executes the preset write processing. Subsequently, the processing proceeds to Step 617.

In Step 614, the CPU 11 checks the chord change flag CHDCHG. This flag CHDCHG is set when the chord has been changed in accordance with the depression of a key on the lower keyboard 14 or the pedal keyboard 15 (Step 120 of FIG. 9). If CHDCHG is "0", the CPU 11 cancels this tempo interrupt processing, and returns its control to the previous routine. If CHDCHG is "1", the CPU 11 executes the note-length change processing starting from Step 700 (FIG. 29). Subsequently, the processing proceeds to Step 617.

In Step 617, the CPU 11 stores a "1" in the note-length register LENGTH, and then the CPU 11 executes the previously-described chord write processing (FIG. 17) and the memory remaining capacity display processing (FIG. 18). Moreover, the CPU 11 clears in Step 619 the sequencer counter CNT, the preset change flag PRECHG and the chord change flag CHDCHG. Then, the CPU 11 cancels this tempo interrupt processing, and returns its control to the previous routine.

18. Sequencer Readout Processing

When the beat top state is obtained during the running of a rhythm in the NORMAL mode and in the ON state of the sequencer, the beat top processing is executed. While the beat top processing is being executed, if the sequencer counter CNT reaches "0", the CPU 11 executes this sequencer readout processing.

Figure 27A:
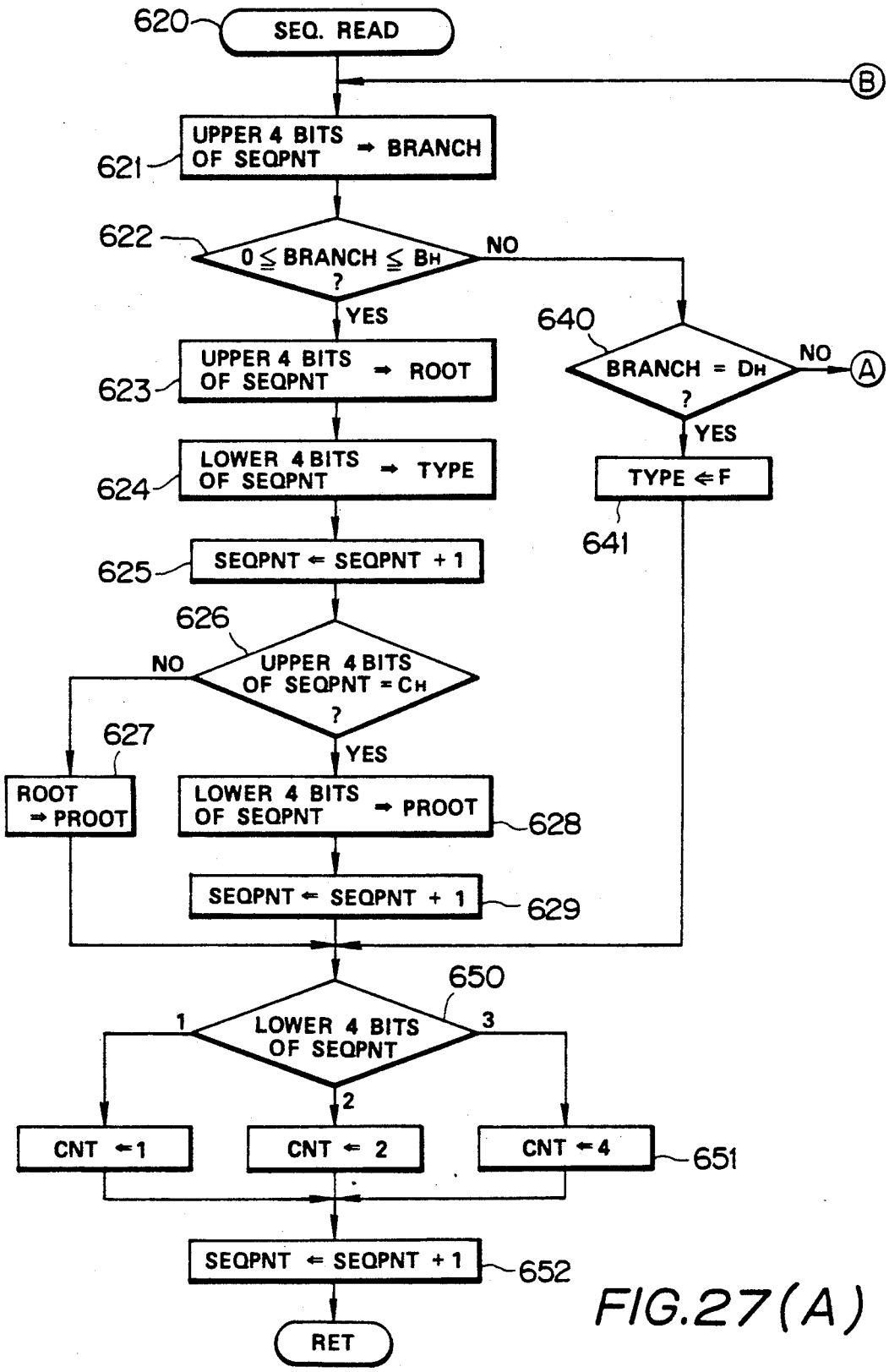
FIG. 27(A) is a flow chart of the sequencer readout processing executed by the CPU 11 of the embodiment of FIG. 1.

Referring to FIG. 27(A), in Step 621, the CPU 11 stores, in the register BRANCH, the higher-order 4 bits of the data (SEQPNT) in the sequencer memory 19 designated by the sequencer pointer SEQPNT. Subsequently, in Step 622, the CPU 11 judges whether or not this 4-bit data BRANCH is any of the root data ("0" to "BH").

If the data BRANCH is any of the roots ("0" to "BH"), the data (SEQPNT) represents the name of chord. Therefore, the CPU 11 stores the higher-order 4 bits of such data in the root register ROOT in Step 623, and in Step 624 stores the lowerorder 4 bits of the same in the chord type register TYPE. Moreover, the pointer SEQPNT is advanced in Step 625, and, in Step 626, the CPU 11 judges whether or not the next data (SEQPNT) is "CH". If the data is not "CH", this means that such data is the second byte of the normal chord data (the chord-2 of FIG. 4). Therefore, the CPU 11 stores the root ROOT in the base root register PROOT (Step 627), then proceeding the control to Step 650. On the other hand, if the aforesaid data (SEQPNT is "CH", this means that such data is the second byte of the fractional chord data (the chord-1 of FIG. 4). Therefore, the CPU 11 stores the lower-order 4 bits of this data in the register PROOT (Step 628). Subsequently, after the pointer SEQPNT has been advanced, the processing proceeds to Step 650.

If the data BRANCH is any data other than the root data ("0" to "BH") in Step 622, the processing proceeds to Step 640. In Step 640, the CPU 11 judges whether or not the data BRANCH is the note-length discrimination mark "DH". If the data BRANCH is "DH", the CPU 11 stores the data "FH" (nonestablishment of any chord, non-generation of any tone) in the chord type register TYPE in Step 641, and the processing then proceeds to Step 650.

In Step 650, the CPU 11 checks the note-length data stored in the second byte of the normal chord, in the third byte of the factional chord and in the lower-order 4 bits of the rest data (1 byte). In Step 651, the CPU 11 stores data representative of the number of beats corresponding to the note-length data into the sequencer beat-number counter CNT. Subsequently, in Step 652, the CPU 11 further advances the pointer SEQPNT so as to be set to the top address of the next word, cancels this tempo interrupt processing, and returns the control to the previous routine.

Figure 27B:
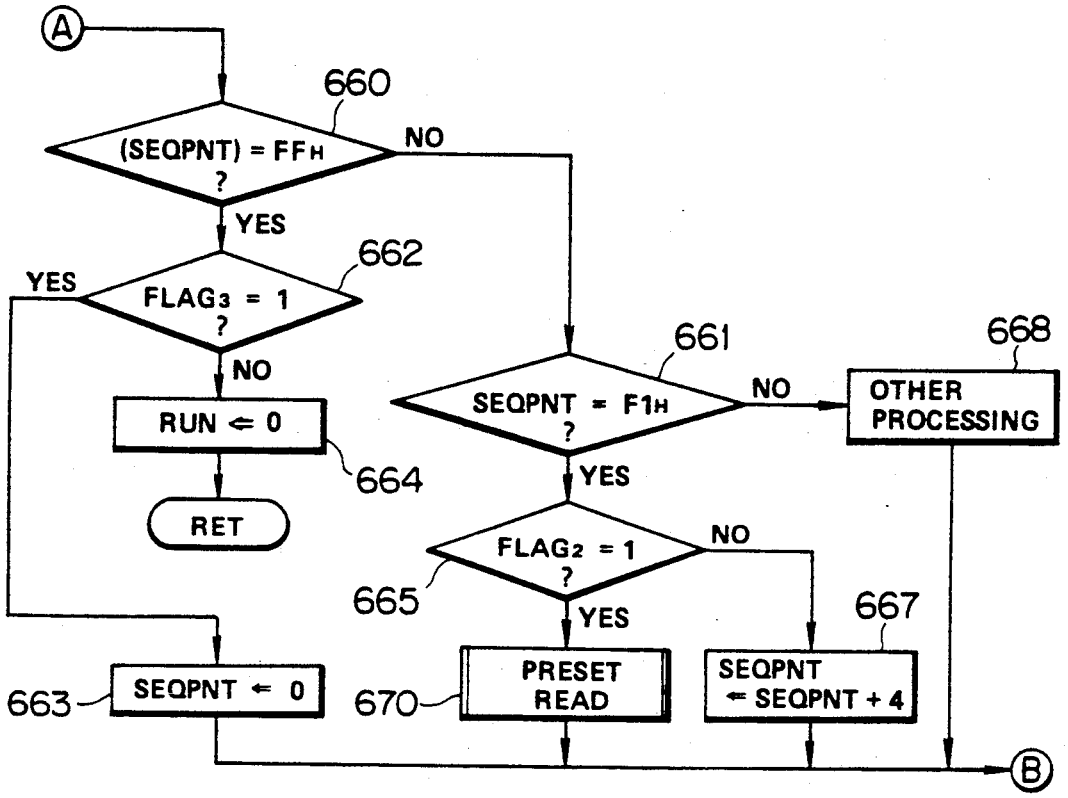
FIG. 27(B) is a continuation of the flow chart of FIG. 27(A)

If the data BRANCH is determined to be neither any of the root tones ("0" to "BH") nor the note-length discrimination mark "DH" as the result of the judgment in Steps 622 and 640, the processing proceeds to Step 660 of FIG. 27(B). In Step 660, the CPU 11 judges whether or not the 8-bit data (SEQPNT) including the data BRANCH is "FFH" (the end mark). If the data is not the end mark, the CPU 11 judges, in Step 661, whether or not the data (SEQPNT) is "F1H" (the preset start mark).

If the data (SEQPNT) is "FFH" (or the end mark), the processing proceeds from Step 660 to 662, in which the CPU 11 checks $FLAG_3$. If the $FLAG_3$ is "1" (REPEAT=ON), the CPU 11 clears the pointer SEQPNT in Step 663. Subsequently, the processing returns to Step 621 of FIG. 27(A), and the CPU 11 again reads out the data at the top address of the memory 19. On the other hand, if it is judged in Step 662 of FIG. 27(B) that $FLAG_3$ is "0" (REPEAT is OFF), the CPU 11 resets the run flag RUN in Step 644, and then it cancels this tempo interrupt processing, returning the control to the previous routine.

If the data (SEQPNT) is "F1H" (or the preset start mark), the processing proceeds from Step 661 to Step 665 in which the CPU 11 checks $FLAG_2$. If $FLAG_2$ is "1" (the preset sequence is ON), the CPU 11 carries out the preset read processing (FIG. 28) in Step 670, and then returns its control to Step 621 of FIG. 27(A). On the other hand, if $FLAG_2$ is "0", it is not necessary to read this 4-byte preset data. Therefore, after the CPU 11 has advanced the pointer (SEQPNT) by "4" (independently of the data) in Step 667 of FIG. 27(B), the processing returns to Step 621 of FIG. 27(A) and the CPU 11 reads the next word of data from the memory 19.

It is to be noted that, if the data BRANCH is neither any of the roots ("0" to "BH") nor the note-length discrimination mark and if the data (SEQPNT) is neither "FFH" nor "F1H", the CPU 11 executes a predetermined processing such as display of an error or an interpolation of data in Step 668 of FIG. 27(B). Subsequently, the processing returns to Step 621 of FIG. 27(A), and the CPU 11 starts to read the following data from the memory 19.

19. Preset Readout Processing

When it has been judged in the foregoing Step 665 that the preset sequence is ON ($FLAG_2$="1"), the CPU 11 executes this preset readout processing.

Figure 28:
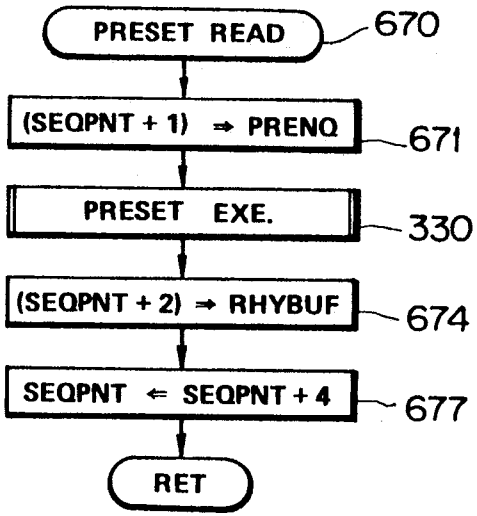
FIG. 28 is a flow chart of the preset readout processing executed by the CPU 11 of the embodiment of FIG. 1.

Referring to FIG. 28, the CPU 11 stores in the preset number register PRENO the data at the address of the sequencer memory 19 next to that address designated by the pointer SEQPNT, that is, the data (SEQPNT+1) in the second byte of the preset data, and then executes the previously-described preset exchange processing (FIG. 21). In Step 674, the CPU 11 stores, in the rhythm data buffer RHYBUf (FIG. 7), the data in the third byte of the preset data (SEQPNT+2). Then, the CPU 11 advances the pointer SEQPNT by "4" in Step 677 so as to be set to the top address of the next word, and the CPU 11 cancels this tempo interrupt processing and returns its control to the previous routine.

20. Note-Length Change Processing

This note-length change processing is executed when any one of the preset switches 55 to 70 is operated (Step 613) while the writing being effected on the sequencer at real time and when the chord which is being input through the keyboard 14 or 15 is changed (Step 614), in the previously-described beat top processing (FIG. 26) during the REAL-TIME WRITE mode (MODE="2"). During the REAL-TIME WRITE mode, the note-length of the preceding chord cannot be discriminated until any change, for example, of a chord is detected. Therefore, if one chord is key-depressed and then released, the chord and the note-length of the chord are written upon depression of the key and upon release of the key, respectively.

Referring to FIG. 29, in Steps 701 to 703, the CPU 11 checks the count value of the sequencer counter CNT. If the count value CNT is greater than or equal to "4", the CPU 11 stores, in Step 705, the note-length data "D3H" into the register LEN, and the control variable of "4" into the register DEC. Subsequently, the processing proceeds to Step 708. On the other hand, if $2 < CNT \leqq 4$ is established, the CPU 11 stores, in Step 707, the note-length data "D2H" into the register LEN, and the control variable of "2" into the register DEC. Then, the processing proceeds to Step 708.

In Step 708, the CPU 11 writes the note-length data ("D3H" or "D2H") contained in the register LEN into the note-length data portion (SEQPNT−1) of the preceding chord data. In Step 709, the CPU 1 judges whether or not the preceding chord was a fractional chord. Since the chord data is composed of 2 bytes (a normal chord) or of 3 bytes (a fractional chord), in the case of the fractional chord, the chord of the preceding chord data is the data (SEQPNT−3) which is disposed three bytes before. If the preceding chord data is not of a fractional chord, the chord is the data (SEQPNT−2) which is disposed two bytes before.

In Steps 710, 711 and 720, the chord-name data [SEQPNT−3 (or 2)] representative of the name of the chord of the preceding chord is stored (copied) as the data (SEQPNT) of the chord for the keys which are currently depressed. In addition, in the case of the fractional chord, the base root data (SEQPNT−2) is stored (copied) as the base root data (SEQPNT+1). In Step 712 and 722, the data "D1H" is stored as the note-length data (SEQPNT+1) ("SEQPNT+2" in the case of a fractional chord) of the chord for the keys which are presently depressed. (This storage is temporal and is rewritten when Step 700 is again carried out.) In Steps 713 and 723, the pointer SEQPNT is advanced by "2" (a normal chord) or by "3" (a fractional chord) sc as to be set to the top address of the next chord data. In Step 714, the CPU 11 sets the fractional chord flag LONG to "1", and, in Step 724, resets the same flag LONG to "0". After the counter CNT has been decremented by that control variable DEC in Step 715, the processing returns to Step 701.

In the above Steps 701 to 703, when the count value CNT of the counter for the sequencer is smaller than "1", the processing proceeds from Step 703 to Step 730. The CPU 11 returns the pointer SEQPNT to the top address of the preceding chord data (Steps 730 to 732). The CPU 11 then write the end mark "FFH" into this top address (Step 733), cancels the tempo interrupt processing, and returns the control to the previous routine. On the other hand, in the above Steps 701 to 703, if $1 < CNT \leqq 2$ is established, the CPU 11 writes the end mark "FFH" into the current address SEQPNT (Step 733), cancels the tempo interrupt processing, and returns the control to the previous routine.

The present electronic musical instrument is thus arranged such that an automatic accompaniment is played based on a chord such as a rhythmic chord in a first tone color whose timing is controlled, while a tone is generated in response to depressions of keys in a second tone color, whereby it is possible to play a musical performance full of variety. In addition, it is possible by changing the mode to play an automatic musical performance simultaneously with a real-time performance like that on a conventional instrument.

Figure 30A:
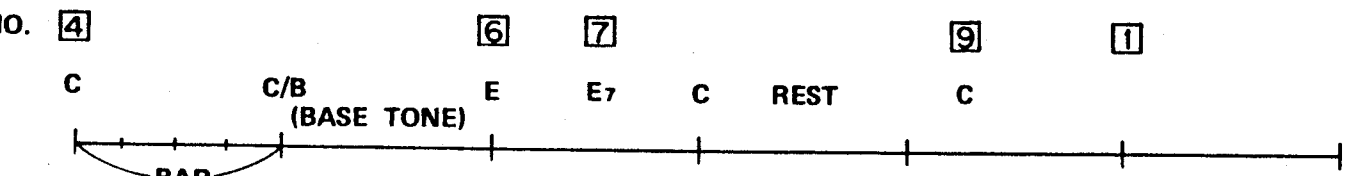
FIG. 30*a* is a diagram of an example of the musical-performance data processed in the embodiment of FIG. 1.
Figure 30B:
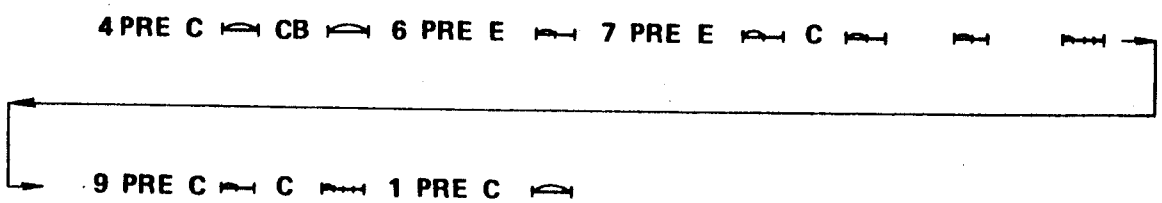
FIG. 30*b* is a sequence diagram of the operation for step-writing the musical-performance data in the embodiment of FIG. 1.

FIG. 30 shows at a) a pattern to be step-written into the electronic musical instrument of FIG. 1, and shows at (b) operating procedures therefor. The preset number can be set in such a manner that after the preset number has been designated by a desired one of the switches 55 to 70, the PRE switch 36 is turned on. The chord can be set in such a manner that, after the chord has been designated by depressing the lower keyboard 14 and the pedal keyboard 15, the length of the tone is designated by a corresponding one of the note-length switches 37 to 39. Also, the non-chord (a rest) can be set by inputting the note-length data without inputting the chord. Although the chord to be inputted through the lower keyboard may be adapted to be designated by depressing the keys corresponding to all the constituent tones of the chord (the finger mode), it is also possible to select the chord by designating only the root ( Major) or a combination of the root and other white or black keys (the single finger mode).

The foregoing is the embodiment of the present invention, but this invention is not confined solely to the abovedescribed embodiment. The present invention can be implemented in suitable modified forms which will described below by way of example.

(a) In the foregoing embodiment, although the normal play is effected based on the rhythmic chord, other kinds of accompaniment may be performed, and it is also possible to switch over to a mode in which the tone of an accompaniment is made the same as the tone for a depressed key. Other various combinations are also possible.

(b) Music signs such as a repeat (D. S., ... and so on) may be stored in the sequencer, thereby controlling the advancement of the musical performance.

(c) Regarding a beat, not only 4 beats but other beats can be adopted. In this case, although there is a case where the length of note (a bar, a half bar and a quarter bar) is not an integral number of beats, such a number may be rounded off so as to obtain an integral beat.

(d) Although the rhythmic chord has been described as an example of the accompaniment, an arpeggio including polyphonic tones may be used.

(e) The resolution of the sequencer may be set to a value which is finer than one beat.

(f) Although only one sequencer is provided in this embodiment, a plurality of sequencers can easily be incorporated.

(g) Although the sequencer has been referred to as the contents of the multi-menu, other modes for the generation of various rhythm patterns and the changing of tone color can easily be added.

(h) It is also easy to arrange the instrument so that the contents of the sequencer may be edited.

(i) Although two memory blocks for the normal and the preset are provided in the panel memory of the above-described embodiment, these two blocks may be integrated into one block to reduce the capacity of the memory.

With the structure of the electronic musical instrument according to the present invention, the musical performance data is recorded not by storing the note name of each operated key but by storing each chord, so that the capacity of the memory required to record the musical performance data, particularly of an accompaniment, can be remarkably reduced.

With the structure of the present invention, the automatic musical performance based on the recorded data relating to the keyboard and the automatic change of state of the control elements of the control panel can be effected independently of each other. Therefore, the following advantages are obtained:

(i) In the chord sequencer mode wherein a music is automatically performed based on the recorded keyboard data, it is possible to automatically perform the music in a tone color and with a musical effect which are different from those selected when the music was recorded. In addition, if the state of the control elements of the control panel is changed by the player when the music is automatically performed, the data relating to the change of state of the control elements need not be recorded, so that the memory capacity can be decreased.

(ii) In the preset sequence mode wherein the state of the control elements is automatically reproduced, the player need not operate the control elements and may operate only the keys of the keyboard.

(iii) In the mode wherein both the recorded musical performance and the recorded state of the control elements are automatically reproduced, the player can devote himself to performance of a melody.

What is claimed is:

1. An electronic musical instrument having an automatic music playing system having at least a first mode of operation, comprising:

a keyboard having a plurality of keys;

musical performance data generating means for generating musical performance data representative of music to be automatically played;

first tone generating means, responsive to each key depressed on said keyboard in said first mode of operation for generating a first musical tone corresponding to the depressed key or keys;

second tone generating means, responsive to said musical performance data in said first mode of operation for generating a second musical tone determined by said musical performance data independently of said depressed key or keys; and tone color assignment means for assigning first and second tone colors respectively to said first tone generating means and said second tone generating means to cause said first and second generating means to generate said first and second musical tones in said first and second tone colors, respectively, in said first mode of operation.

2. An electronic musical instrument according to claim 1, further comprising a melody keyboard and wherein said musical performance data generating means includes means for storing an automatic accompaniment for a musical piece performed on said melody keyboard as said musical performance data, and wherein said keyboard is a manual accompaniment keyboard for performing a manual accompaniment independently of said automatic accompaniment.

3. An electronic musical instrument having an automatic music playing system having at least a first mode of operation, comprising:

a keyboard having a plurality of keys;

musical performance data generating means for generating musical performance data representative to music to be automatically played, said musical performance data generating means comprising:

memory means for storing said musical performance data;

tempo clock signal generating means for generating a tempo clock signal representative of a tempo at which said music is to be automatically performed, said tempo clock signal being independent of depression of said keys; and reading means responsive to said tempo clock signal for reading said musical performance data from said memory means at said tempo;

first tone generating means, responsive to each key depressed on said keyboard in said first mode of operation for generating a first musical tone corresponding to the depressed key or keys;

second tone generating means, responsive to said musical performance data in said first mode of operation for generating a second musical tone determined by said musical performance data; and tone color assignment means for assigning first and second tone colors respectively to said first tone generating means and said second tone generating means to cause said first and second generating means to generate said first and second musical tones in said first and second tone colors, respectively, in said first mode of operation.

4. An electronic musical instrument according to claim 3 further comprising musical performance data storing means cooperative with said keyboard for storing, into said memory means, data representative of each key depressed on said keyboard to form said musical performance data in said memory means.

5. An electronic musical instrument according to claim 3 further comprising note-length data generating means for generating note-length data representative of a note length, and wherein said musical performance data storing means is responsive to said note-length data for storing, into said memory means, said data representative of each depressed key together with said note-length data.

6. An electronic musical instrument according to claim 5, wherein said note-length data generating means comprises counter means for counting the tempo clock signals to output a count value of the tempo clock signals as said note-length data.

7. An electronic musical instrument according to claim 5, wherein said note-length data generating means comprises note-length selection switch means for selecting one of a plurality of predetermined note lengths to output note-length selection data as said note-length data.

8. An electronic musical instrument having an automatic music playing system comprising:

a keyboard having a plurality of keys;

note-length data generating means for generating note-length data representative of a note length;

chord detection means responsive to each depression of a key or keys on said keyboard for detecting a chord represented by said each depression of a key or keys and for outputting chord data representative of the detected chord;

memory means for storing musical performance data representative of a musical performance to be automatically played;

musical performance data storing means responsive to said each depression of a key or keys on said keyboard for storing, into said memory means, said chord data together with said note-length data for form said musical performance data in said memory means;

tempo clock signal generating means for generating a tempo clock signal representative of a tempo at which said music is to be automatically played; and musical performance data reading means responsive to said tempo clock signal for reading said musical performance data from said memory means at said tempo, so that a musical tone having at one pitch determined by said chord data and having a time length determined by said note-length data can be produced.

9. An electronic musical instrument according to claim 8, wherein said note-length data generating means comprises counter means for counting the tempo clock signals to output a count value of the tempo clock signals as said note-length data.

10. An electronic musical instrument according to claim 8, wherein said note-length data generating means comprises notelength selection switch means for selecting one a plurality of predetermined note lengths to output note-length selection data representative of the selected note-length as said notelength data.

11. An electronic musical instrument according to any one of claims 8–10, further comprising a melody keyboard and wherein said keyboard is a manual accompaniment keyboard for performing an accompaniment of a musical piece performed on said melody keyboard.

12. An electronic musical instrument having an automatic music playing system comprising:

a keyboard having a plurality of keys each for determining a pitch of a tone to be generated;

tone control means having a plurality of control elements for outputting tone control signals for determining conditions of generation of said tone;

memory means for storing first musical performance data corresponding to a music to be automatically played and relating to depressions of keys on said keyboard, and second musical performance data corresponding to said music and relating to states of said control elements;

tempo clock signal generating means for generating a tempo clock signal representative of a tempo at which said music is to be automatically played;

musical performance data reading means responsive to said tempo clock signal for selectively reading at least one of said first musical performance data and said second musical performance data from said memory means at said tempo, so that said music to be automatically played is performed when said first musical performance data is read from said memory means and that said control elements are brought into states determined by said second musical performance data when said second musical performance data is read from said memory means.

13. An electronic musical instrument according to claim 12 further comprising musical performance data storing means cooperative with said keyboard for storing, into said memory means, data representative of each key depressed on said keyboard to form said first musical performance data in said memory means.

14. An electronic musical instrument according to claim 13 further comprising note-length data generating means for generating note-length data representative of a note length, and wherein said musical performance data storing means is responsive to said note-length data for storing, into said memory means, said data representative of each depressed key together with said note-length data to form said first musical performance data in said memory means.

15. An electronic musical instrument according to claim 14, wherein said note-length data generating means comprises counter means for counting the tempo clock signals to output a count value of the tempo clock signals as said note-length data.

16. An electronic musical instrument according to claim 14, wherein said note-length data generating means comprises note-length selection switch means for selecting one of a plurality of predetermined note lengths to output note-length selection data representative of the selected note length as said note-length data.

17. An electronic musical instrument according to claim 13 further comprising second musical performance data storing means for storing data corresponding to said tone control signals into said memory means to form said second musical performance data in said memory means.

18. An electronic musical instrument according to claim 12, wherein said music represented by said first and second musical performance data is an accompaniment of a music, and wherein said keyboard is a keyboard for performing an accompaniment.

19. An electronic musical instrument comprising:

a first group of keys for use during a melody performance;

melody tone generator means for providing musical tones in response to manual activation of keys in said first groups of keys; and an accompaniment system, comprising:

a second group of keys for use during an accompaniment performance;

first accompaniment tone generator means for generating musical tones in response to manual activation of any of the keys in said second group of keys, wherein one musical tone is generated in response to the activation of each key;

musical performance memory means for storing automatic performance data;

second accompaniment tone generating means, responsive to activation of any of the keys in said second group of keys, for generating automatic accompaniment musical tones in accordance with said automatic performance data; and tone color means for providing separate tone colors to the musical tones generated by each of said first and second accompaniment tone generator means.

20. An electronic musical instrument as set out in claim 19, wherein said first group of keys and said second group of keys are on separate keyboards.

* * * * *